US011199188B2

(12) United States Patent
Jo et al.

(10) Patent No.: US 11,199,188 B2
(45) Date of Patent: Dec. 14, 2021

(54) SCROLL COMPRESSOR HAVING ANTI-ROTATION RING

(71) Applicant: LG ELECTRONICS INC., Seoul (KR)

(72) Inventors: Changeol Jo, Seoul (KR); Suchul Kim, Seoul (KR); Donghyun Sohn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/911,636

(22) Filed: Jun. 25, 2020

(65) Prior Publication Data

US 2021/0115923 A1 Apr. 22, 2021

(30) Foreign Application Priority Data

Oct. 22, 2019 (KR) ..... 10-2019-0131689

(51) Int. Cl.
*F04C 18/02* (2006.01)
*F04C 29/00* (2006.01)
*F01C 17/06* (2006.01)

(52) U.S. Cl.
CPC ..... *F04C 18/0215* (2013.01); *F01C 17/066* (2013.01); *F04C 29/0057* (2013.01); (Continued)

(58) Field of Classification Search
CPC ..... F04C 2/025; F04C 18/0207–0292; F04C 15/0065; F04C 29/0057; F01C 1/0207–0292; F01C 17/066
See application file for complete search history.

(56) References Cited

U.S. PATENT DOCUMENTS 5,080,566 A * 1/1992 Sakata ..... F01C 1/0215 418/188
5,342,184 A 8/1994 Comparin
(Continued)

FOREIGN PATENT DOCUMENTS

JP 2000-283063 10/2000
JP 2000283063 A * 10/2000 ..... F01C 17/066
(Continued)

OTHER PUBLICATIONS

Korean Office Action dated Dec. 15, 2020 issued in KR Application No. 10-2019-0131689.

*Primary Examiner* — Laert Dounis
(74) *Attorney, Agent, or Firm* — Ked & Associates LLP

(57) ABSTRACT

A scroll compressor may include a frame, an orbiting scroll provided with at least one first key groove, a non-orbiting scroll provided with at least one second key groove and coupled to the orbiting scroll to form a compression chamber, and an anti-rotation ring disposed between the frame and the orbiting scroll. The anti-rotation ring may include a ring, at least one first key that axially extends from a first surface of the ring and slidingly coupled to the at least one first key groove of the orbiting scroll, and at least one second key that axially extends from the first surface of the ring and slidingly coupled to the at least one second key groove of the non-orbiting scroll. The first and second keys may be provided along a circumferential direction. This may allow processability of a one-way anti-rotation ring. Further, increase in weight may be prevented while reducing deformation by providing a weight-reduced portion in addition to a reinforcing portion.

21 Claims, 16 Drawing Sheets

(52) U.S. Cl.
CPC ..... *F04C 2240/20* (2013.01); *F05B 2210/14* (2013.01); *F05B 2280/1021* (2013.01)

(56) References Cited

U.S. PATENT DOCUMENTS

| | | | | |
|---|---|---|---|---|
| 8,356,987 | B2 * | 1/2013 | Guo | F01C 21/10 418/55.5 |
| 2009/0047161 | A1 * | 2/2009 | Ginies | F04C 18/0215 418/55.3 |
| 2010/0215536 | A1 * | 8/2010 | Kiyokawa | F01C 17/066 418/55.3 |
| 2017/0067466 | A1 * | 3/2017 | Oh | F01C 17/066 |

FOREIGN PATENT DOCUMENTS

| | | | | |
|---|---|---|---|---|
| JP | 2003239874 | A * | 8/2003 | |
| JP | 2010-190164 | | 9/2010 | |
| JP | 2014-029117 | | 2/2014 | |
| JP | 2014029117 | A * | 2/2014 | |
| KR | 10-0686760 | | 2/2007 | |
| KR | 10-2017-0029313 | | 3/2017 | |
| WO | WO-2014051085 | A1 * | 4/2014 | F25B 31/004 |

* cited by examiner

SCROLL COMPRESSOR HAVING ANTI-ROTATION RING

CROSS-REFERENCE TO RELATED APPLICATION(S)

Pursuant to 35 U.S.C. § 119(a), this application claims the benefit of the earlier filing date and the right of priority to Korean Patent Application No. 10-2019-0131689, filed in Korea on Oct. 22, 2019, the contents of which is incorporated by reference herein in its entirety.

BACKGROUND

1. Field

A scroll compressor, and more particularly, a scroll compressor having an anti-rotation ring is disclosed herein.

2. Background

In a scroll compressor, an orbiting scroll and a non-orbiting (or fixed) scroll are coupled by being engaged with each other. As the orbiting scroll performs an orbiting motion with respect to the non-orbiting scroll, the non-orbiting scroll forms a pair of compression chambers together with the orbiting scroll.

An anti-rotation member or ring is provided between the orbiting scroll and a frame, or between the orbiting scroll and the non-orbiting scroll. Accordingly, the orbiting scroll performs an orbiting motion while being coupled to a rotational shaft.

The anti-rotation member is mainly classified into a pin and ring type and an Oldham ring type. For the pin and ring type, a plurality of pins and a plurality of rings into which the plurality of pins is inserted to allow the plurality of pins to perform an orbiting motion are provided. In the Oldham ring, keys are configured to slide in key grooves in different directions. The Oldham ring is employed in embodiments disclosed herein.

In the Oldham ring, a plurality of keys is provided at a ring having an annular shape. The key may be provided on both surfaces of the ring in an axial direction, respectively, or may be provided on any one surface. For the sake of convenience, the former may be referred to as a 'two-way anti-rotation member' and the latter as a 'one-way anti-rotation member'. KR 10-2017-0029313 (hereinafter, referred to "Patent Document 1"), which is hereby incorporated by reference, discloses an Oldham ring structure corresponding to a two-way anti-rotation member, and U.S. Pat. No. 5,342,184 (hereinafter, referred to "Patent Document 2"), which is hereby incorporated by reference, discloses an Oldham ring structure corresponding to a one-way anti-rotation member.

In Patent Document 1, the Oldham ring is located between an orbiting scroll and a frame, and a first key slides into a first key groove of the orbiting scroll and a second key slides into a second key groove of the frame. In this case, one or a first side of the orbiting scroll is coupled to a non-orbiting scroll while another or a second side is coupled to the frame through the Oldham ring. That is, the frame-Oldham ring-orbiting scroll-non-orbiting scroll are coupled in a sequential manner. Accordingly, accuracy of processing (or fabrication) and assembly of the frame, Oldham ring, orbiting scroll, and non-orbiting scroll is required to improve a degree of alignment between components and enhance compressor performance.

In Patent Document 2, the Oldham ring is located between a frame and an orbiting scroll, and a first key slides into a first key groove of the orbiting scroll and a second key slides into a second key groove of a non-orbiting scroll. In this case, the orbiting scroll-Oldham ring-non-orbiting scroll are coupled with each other. Accordingly, a number of components engaged with each other is reduced compared to Patent Document 1, so that the degree of alignment between components is increased relative to accuracy of processing and assembly.

However, in the case of Patent Document 2, as the Oldham ring is coupled to the non-orbiting scroll with the orbiting scroll interposed therebetween, the second key of the Oldham ring has to be located outside of an outer diameter of the orbiting scroll. Due to this, an axial length of the second key is increased, and a thickness of the second key should be increased accordingly. This may be a factor that causes an increase in weight of the Oldham ring. As a result, motor efficiency and compressor performance may be deteriorated.

In addition, for Patent Document 2, as the first key and the second key are provided at one surface of a ring, an amount of deformation of the ring increases. In Patent Document 2, load is applied to first and second keys in the same direction, which causes an increase in moment load. In addition, a length of the second key increases, and a length of a moment arm is increased accordingly. As a result, a twisting (or torsional) moment acting on the ring is increased, which may lead to a decrease in durability of the Oldham ring or an increase in friction loss between the key grooves of the keys.

Further, in the case of Patent Document 2, in order to reduce an outer diameter of the orbiting scroll, the first key is located eccentrically from a virtual line that passes through a center of the orbiting scroll, making it difficult to set a starting point during processing of the orbiting scroll. As a result, processability (or workability) and processing precision may be reduced. In addition, as the first key is thin and protrudes to an outside of an orbiting end plate, reliability of the first key may be deteriorated.

BRIEF DESCRIPTION OF THE DRAWINGS

Embodiments will be described in detail with reference to the following drawings in which like reference numerals refer to like elements, and wherein.

DETAILED DESCRIPTION

Figure 1:
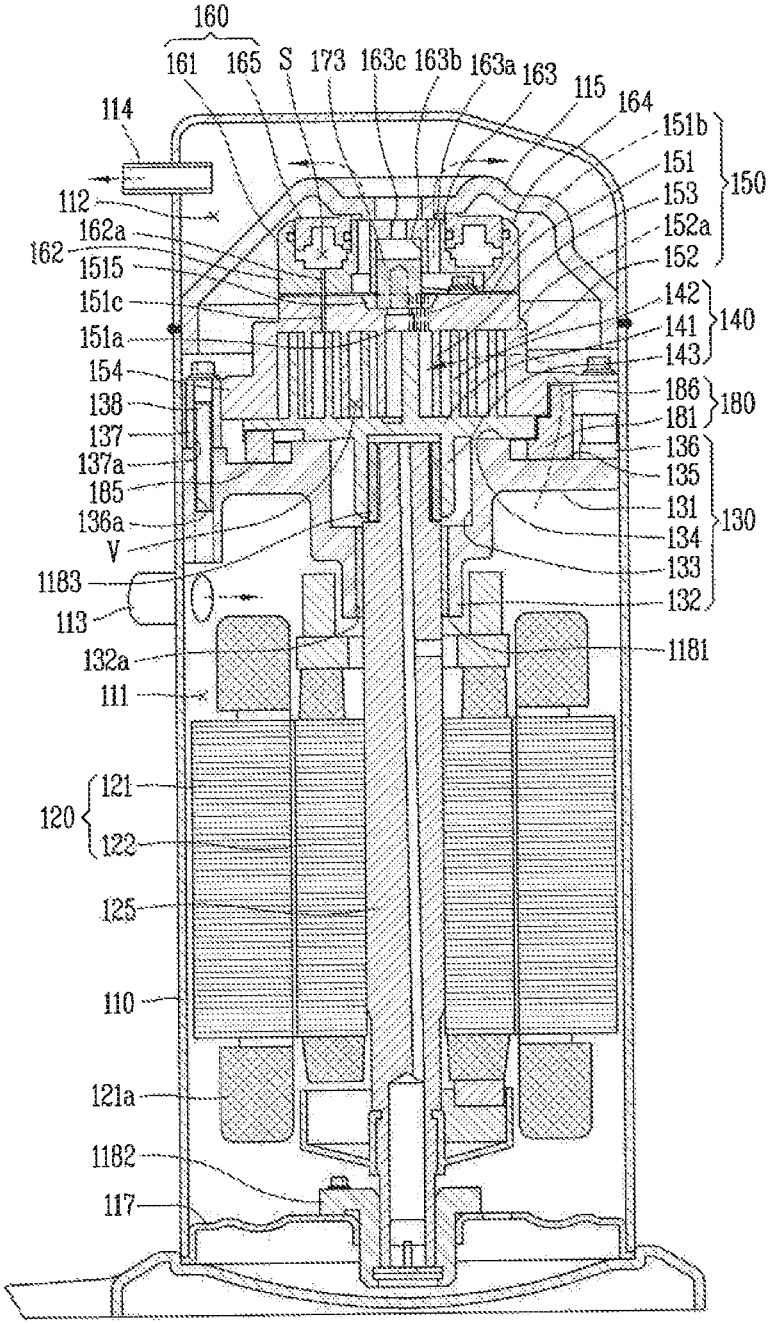
FIG. 1 is a longitudinal cross-sectional view of a scroll compressor according to an embodiment.

Description will now be given of a scroll compressor according to embodiments disclosed herein, with reference to the accompanying drawings. Wherever possible, the same or like reference numerals have been used to indicate the same or like elements and repetitive disclosure has been omitted.

Figure 2:
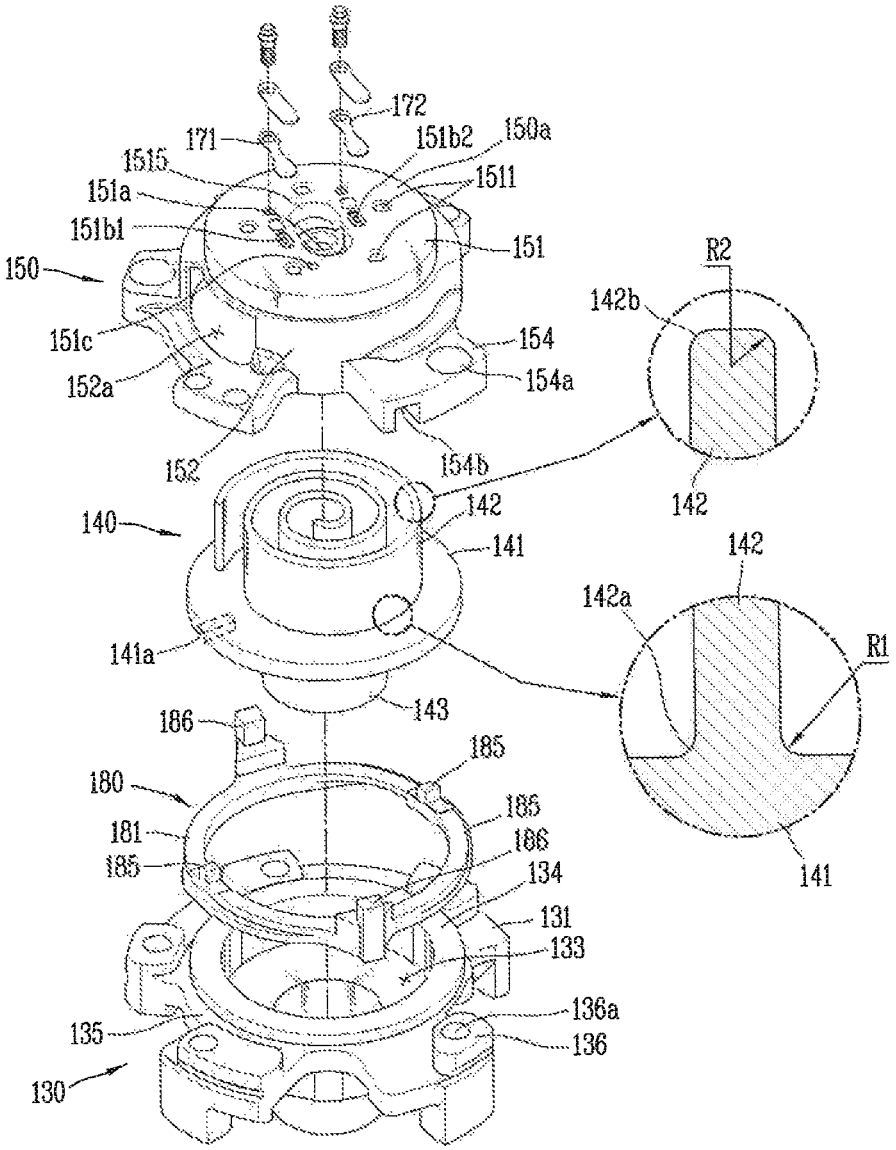
FIG. 2 is a perspective view illustrating a compression unit separated from the scroll compressor according to FIG. 1.
Figure 3:
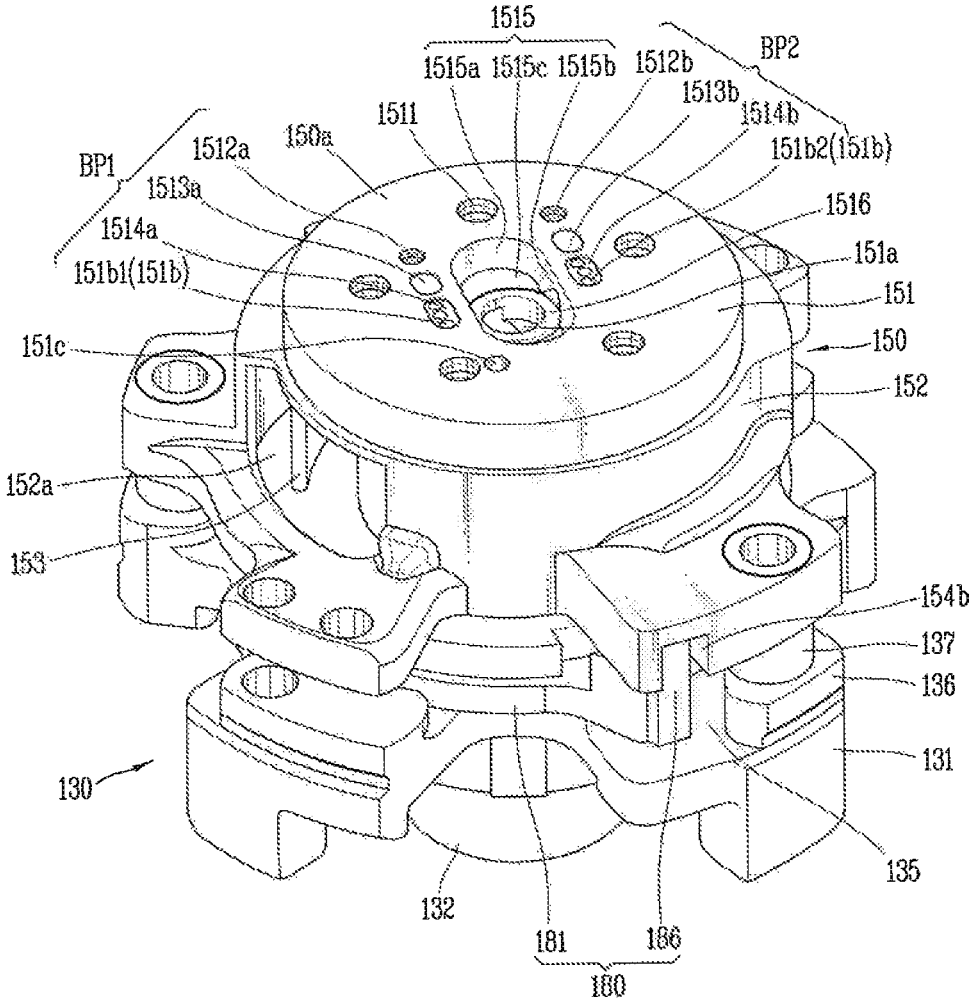
FIG. 3 is a perspective view illustrating the compression unit assembled to the scroll compressor according to FIG. 2.
Figure 4:
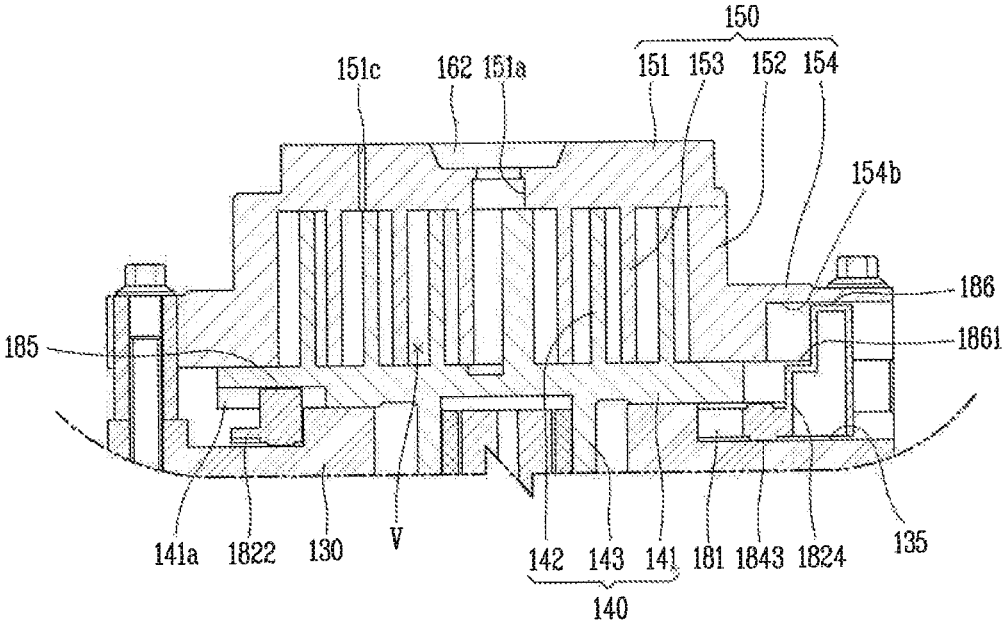
FIG. 4 is a cross-sectional view of the compression unit in FIG. 3.

FIG. 1 is a longitudinal cross-sectional view of a scroll compressor according to an embodiment. FIG. 2 is a perspective view illustrating a compression unit separated from the scroll compressor according to FIG. 1. FIG. 3 is a perspective view illustrating the compression unit assembled to the scroll compressor according to FIG. 2. FIG. 4 is a cross-sectional view of the compression unit in FIG. 3.

Referring to FIG. 1, in a scroll compressor according to an embodiment, an inner space of a casing 110 may be hermetically sealed, and a suction space 111 which is a low-pressure portion, and a discharge space 112 which is a high-pressure portion may be separated or divided by a high-low pressure separating plate 115. The high-low pressure separating plate 115 may be installed at an upper portion of a non-orbiting scroll 150 described hereinafter. Accordingly, the suction space 111 may define a lower space of the high-low pressure separating plate 115, and the discharge space 112 may define an upper space of the high-low pressure separating plate 115. A suction pipe 113 may communicate with the suction space 111 of the casing 110, and a discharge pipe 114 may communicate with the discharge space 112 of the casing 110.

A drive motor 120 including a stator 121 and a rotor 122 may be installed in the suction space 111 of the casing 110 according to this embodiment. The stator 121 may be fixed to an inner wall surface of the casing 110 in, for example, a shrink-fitting manner, and the rotor 122 may be rotatably provided inside of the stator 121.

A coil 121*a* may be wound around the stator 121. The coil 121*a* may be electrically connected to an external power source through a terminal (not shown) coupled to the casing 110 in a penetrating manner. A rotational shaft 125 may be inserted into a central portion of the rotor 122 to be coupled thereto.

An upper end and a lower end of the rotational shaft 125 may be rotatably inserted into a main frame 130 and a sub frame 117, respectively, so as to be supported in a radial direction. A main bearing 1181 and a sub bearing 1182 that support the rotational shaft 125 may be inserted into the main frame 130 and the sub frame 117, respectively, so as to be fixedly coupled. Each of the main bearing 1181 and the sub bearing 1182 may be configured as a bush bearing.

Referring to FIGS. 2 to 4, in the main frame 130 according to this embodiment, a main flange 131 may be fixedly coupled to the inner wall surface of the casing 110, as the sub frame 117. A main bearing portion 132 may protrude downward, namely, toward the drive motor 120 from a bottom surface of the main flange 131.

A shaft hole 132*a* may be formed through the main bearing portion 132 in an axial direction so as to allow the rotational shaft 125 to be inserted. The main bearing 1181 implemented as a bush bearing may be inserted into an, inner circumferential surface of the shaft hole 132*a* to be fixedly coupled. The rotational shaft 125 may be inserted into the main bearing 1181 to be radially supported.

An orbiting space 133 in which a rotational shaft coupling portion 143 of the orbiting scroll 140 may be accommodated in an orbiting manner may be provided on an upper surface of the main flange 131. A scroll support surface 134 may be provided at an outside of the orbiting space 133. An Oldham ring accommodating portion 135 in which an Oldham ring 180 may be accommodated in an orbiting manner may be provided at an outside of the scroll support surface 134. A scroll fixing portion 136 that axially and radially supports the non-orbiting scroll 150 may be provided at an outside of the Oldham ring accommodating portion 135.

A plurality of scroll fixing portions 136 may be spaced apart from the Oldham ring accommodating portion 135 along a circumferential direction. A fastening hole 136*a* is provided in each of the scroll fixing portions 136. Accordingly, a guide 137 that passes through a guide passing hole 154*a* of the non-orbiting scroll 150, which will be described hereinafter. Each guide 137 may be axially supported by a respective scroll fixing portion 136.

The guide 137 may be provided with a guide hole 137*a* axially formed therethrough. A guide bolt 138 may be fixed to the fastening hole 136*a* of the scroll fixing portion 136 by penetrating through the guide hole 137*a*. Accordingly, the non-orbiting scroll 150 may be slidably supported on the main frame 130 in the axial direction and may be fixed in the radial direction.

Referring to FIGS. 2 to 4, the orbiting scroll 140 according to this embodiment may be disposed on an upper surface of the main frame 130. The orbiting scroll 140 may perform an orbiting motion between the main frame 130 and the non-orbiting scroll 150 described hereinafter.

The orbiting scroll 140 according to this embodiment may include an orbiting end plate 141, and an orbiting wrap 142 provided on one surface of the orbiting end plate 141. The orbiting end plate 141 may be formed in a substantially disc shape. The orbiting wrap 142 may extend from an upper surface of the orbiting end plate 141, and rotational shaft coupling portion 143 to which the rotational shaft 125 may be coupled may be provided on a lower surface of the orbiting end plate 141. Accordingly, a rotational force of the rotational shaft 125 may be transmitted to the orbiting end plate 141, allowing the orbiting end plate 141 to perform an orbiting motion.

The orbiting wrap 142 may extend from the upper surface of the orbiting end plate 141 in a spiral shape. The orbiting wrap 142 may form a pair of compression chambers V together with a non-orbiting wrap 153 of the non-orbiting scroll 150 described hereinafter.

The pair of compression chambers V may include a first compression chamber V1 and a second compression chamber V2. The first compression chamber V1 and the second compression chamber V2 may be respectively formed at an outer surface and an inner surface with respect to the non-orbiting wrap 153 described hereinafter. A suction pressure chamber, an intermediate pressure chamber, and a discharge pressure chamber may be sequentially formed at each of the first compression chamber V1 and the second compression chamber V2.

Referring to FIG. 2, a first curved portion 142*a* processed in a rounded shape may be provided at a root end of the orbiting wrap 142, and a second curved portion 142*b* processed in a rounded shape may be provided at an end edge (or corner) of the orbiting wrap 142. A curvature R1 of the first curved portion 142*a* may be equal to a curvature R2 of the second curved portion 142*b*. However, the curvature R1 of the first curved portion 142*a* and the curvature R2 of the second curved surface portion 142*b* may not be equal.

Although not shown in FIG. 2, a curved portion (not shown) may be provided at a root end and an end edge of the non-orbiting wrap 153, so as to correspond to the root end and the end edge of the orbiting wrap 142. In this case, the root end and the end edge of the non-orbiting wrap 153 may correspond to the root end and the end edge of the orbiting wrap 142, respectively.

Accordingly, when the orbiting wrap 142 is engagingly coupled to the non-orbiting wrap 153, which will be described hereinafter, the end edge of the non-orbiting wrap 153 is brought into surface contact with the root end of the orbiting wrap 142, and the root end of the non-orbiting wrap 153 is brought into surface contact with the end edge of the orbiting wrap 142. Compared to an edge of the orbiting wrap 142 or the non-orbiting wrap 153 having a right angle or an inclined surface, refrigerant leakage between the orbiting wrap 142 and the non-orbiting wrap 153 may be suppressed, thereby increasing compression efficiency.

A first key groove 141*a* may be provided at a lower surface of the orbiting end plate 141. Two first key grooves 141*a* with a phase difference of 180° in a circumferential direction may be provided to correspond to a first key (or key portion) described hereinafter. The two first key grooves 141*a* may be located on a virtual line passing through a center of the orbiting end plate 141.

In addition, the first key groove 141*a* may be formed on an outer circumferential surface of the orbiting end plate 141 in the radial direction toward the rotational shaft coupling portion 143. The first key groove 141*a* may have a rectangular shape formed to extend lengthwise in the radial direction. A radial length of the first key groove 141*a* may be greater than a radial length of the first key 185, so as to allow the first key 185 to slide in the radial direction.

Although not shown in the drawings, a reinforcement member (not shown) for preventing abrasion may be provided on both surfaces of the first key 185 or the first key groove 141*a* in the circumferential direction.

The Oldham ring 180 may be provided between the main frame 130 and the orbiting scroll 140, so as to suppress rotation of the orbiting scroll 140. The Oldham ring 180 may be slidingly coupled to the main frame 130 and the orbiting scroll 140, respectively. Alternatively, the Oldham ring 180 may be slidingly coupled to the orbiting scroll 140 and the non-orbiting scroll 150, respectively.

In this embodiment, the Oldham ring 180 is slidingly coupled to the orbiting scroll 140 and the non-orbiting scroll 150, respectively. Accordingly, the first key 185 and a second key 186 are alternately provided on one or a first surface of a ring 181 along the circumferential direction. The first key 185 may be slidingly inserted into the first key groove 141*a* of the orbiting scroll 140, and the second key 186 may be slidingly coupled to a second key groove 154*b* of the non-orbiting scroll 150. The Oldham ring 180 will be described again hereinafter.

Referring to FIGS. 2 to 4, the non-orbiting scroll 150 according to this embodiment may be positioned above the orbiting scroll 140. The non-orbiting scroll 150 may be fixedly coupled to the main frame 130. Alternatively, the non-orbiting scroll 150 may be movably coupled to the main frame 31 in a vertical (up-and down) direction. In this embodiment, the non-orbiting scroll 150 is movably coupled to the main frame 130 in the axial direction.

Referring to FIG. 2, the non-orbiting scroll 150 according to this embodiment may include a non-orbiting end plate 151 having a disk shape, a non-orbiting side wall 152 protruding annularly from a bottom edge of the non-orbiting end plate 151, and the non-orbiting wrap 153 provided at a lower surface of the non-orbiting end plate 151 inside of the non-orbiting side wall 152 and engaged with the orbiting wrap 142 to form a pair of compression chambers V1 and V2.

The non-orbiting wrap 153 may be formed in a spiral shape like the orbiting wrap 142. The root end and the end edge of the non-orbiting wrap 153 are rounded so as to correspond to the root end and the end edge of the orbiting wrap 142 facing each other, as described above. As described above, each of the root ends and the end edges of the non-orbiting wrap 153 and the orbiting wrap 142 may be processed using a tool, such as an end mill (not shown). Accordingly, cut surfaces corresponding to the root ends and the end edges of the non-orbiting wrap 153 and the orbiting wrap 142 may be rounded.

In addition, a side surface of the non-orbiting side wall 152 may be provided with an inlet port 152*a* through which a refrigerant of the suction space 111 may be suctioned into a suction pressure chamber (not shown). An exhaust port 151*a* may be provided at a substantially middle portion of the non-orbiting end plate 151 so that compressed refrigerant may be discharged to the discharge space 112 from a discharge pressure chamber (not shown).

The exhaust port 151*a* provided at a position at which a discharge pressure chamber (not shown) of the first compression chamber V1 and a discharge pressure chamber (not shown) of the second compression chamber V2 communicate with each other. A discharge guide groove 1515 described hereinafter may be provided in a vicinity of the exhaust port 151*a*. Accordingly, an axial length of the exhaust port 151*a* may be less (or shorter) than an axial length of the non-orbiting end plate 151.

For example, the exhaust port 151*a* may be provided at a central portion of the non-orbiting end plate 151. The exhaust port 151*a* may be axially formed through the non-orbiting end plate 151, penetrating from a lower surface toward an upper surface thereof.

An inner diameter of the exhaust port 151*a* may be smaller than an outer diameter of a discharge valve 173. Accordingly, the exhaust port 151*a* may be closed when the discharge valve 173 is descending, and opened when the discharge valve 173 is ascending.

A valve seat surface 1516 may be provided at an outlet end of the exhaust port 151*a*. The valve seat surface 1516 may be formed in an annular shape to cover or surround an outlet end of the exhaust port 151*a*. The valve seat surface 1516 may be disposed higher than a bottom surface 1515*c* of the discharge guide groove 1515, which will be described hereinafter. Accordingly, precision processing for the bottom surface 1515*c* of the discharge guide groove 1515, except the valve seat surface 1516, is not needed, allowing the discharge guide groove 1515 to be easily processed or fabricated.

In addition, the valve seat surface 1516 may be disposed lower than an upper (or top) surface 150*a* of the non-orbiting end plate 151 by the discharge guide groove 1515 described hereinafter. Accordingly, an axial length of the exhaust port 151*a* may be less than an axial thickness of the non-orbiting end plate 151.

The discharge guide groove 1515 may be formed around the exhaust port 151*a*. The discharge guide groove 1515 may be provided in the vicinity of the exhaust port 151*a* on the upper surface 150*a* of the non-orbiting end plate 151. The discharge guide groove 1515 will be described hereinafter together with a bypass hole accommodating groove.

A bypass hole 151*b* is formed in the non-orbiting end plate 151. The bypass hole 151*b* may extend between an inlet port 152*a* and the exhaust port 151*a*, namely, from an intermediate pressure chamber (not shown) to the non-orbiting end plate 151 in the axial direction, so as to communicate with an intermediate exhaust port 163*a*, which will be described hereinafter. As a portion (or some) of the refrigerant pressurized in the compression chambers V1 and V2 may be bypassed to the discharge space 112, over compression of refrigerant in the compression chambers V1 and V2 may be suppressed.

The bypass hole 151*b* may include a first bypass hole 151*b*1 that communicates with the first compression chamber V1 and a second bypass hole 151*b*2 that communicates with the second compression chamber V1. The first bypass hole 151*b*1 and the second bypass hole 151*b*2 may have a phase difference of approximately 180° in the circumferential direction. Accordingly, the first bypass hole 151*b*1 and the second bypass hole 151*b*2 may be located at both sides of the exhaust port 151*a* with the exhaust port 151*a* interposed therebetween. The first bypass hole 151*b*1 and the second bypass hole 151*b*2 may be opened and closed by a first bypass valve 171 and a second bypass valve 172, respectively.

The upper surface 150*a* of the non-orbiting end plate 151 of the non-orbiting scroll 150 may be entirely flat. However, the exhaust port 151*a*, the bypass hole 151*b*, and a back pressure hole 151*c* described hereinafter may be axially formed through the upper surface 150*a* of the non-orbiting end plate 151. A plurality of fastening grooves, or grooves in which the discharge valve or the bypass valve are accommodated may be provided in the vicinity of the exhaust port 151*a*, the bypass hole 151*b*, and the back pressure hole 151*c*.

For example, a fastening groove 1511 to which a back pressure plate 161 may be coupled may be provided at an edge of the upper surface 150*a* of the non-orbiting end plate 151 of the non-orbiting scroll 150 according to this embodiment. A plurality of fastening grooves 1511 may be formed along the circumferential direction with substantially equal intervals therebetween.

Valve fixing grooves 1512*a* and 1512*b* to which the bypass valves 171 and 172 described hereinafter may be fastened may be provided between some of fastening grooves 1511, among the plurality of fixing grooves 1511. The valve fixing grooves 1512*a* and 1512*b* may be provided on opposite sides with respect to the discharge guide grooves 1515 described hereinafter.

A valve that opens and closes the first bypass hole 151*b*1 communicating with the first compression chamber V1 may be referred to as 'first bypass valve' 171, and a valve that opens and closes the second bypass hole 151*b*2 communicating with the second compression chamber V2 may be referred to as 'second bypass valve' 172. In addition, a valve fixing groove for fastening the first bypass valve 171 may be referred to as 'first valve fixing groove' 1512*a*, and a valve fixing groove for fastening the second bypass valve 172 may be referred to as 'second valve fixing groove' 1512*b*.

The first bypass hole 151*b*1 may be provided on or at one side of the first valve fixing groove 1512*a*, and the second bypass hole 151*b*2 may be provided on or at one side of the second valve fixing groove 1512*b*. A first valve buffer (or cushioning) groove 1513*a* may be formed between the first valve fixing groove 1512*a* and the first bypass hole 151*b*1. A second valve buffer groove 1513*b* may be provided between the second valve fixing groove 1512*b* and the second bypass hole 151*b*2.

Accordingly, the first valve fixing groove 1512*a*, the first valve buffer groove 1513*a*, and the first bypass hole 151*b*1 may be located substantially in a straight line. Likewise, the second valve fixing groove 1512*b*, the second valve buffer groove 1513*b*, and the second bypass hole 151*b*2 may be located substantially in a straight line.

The first valve fixing groove 1512*a*, the first valve buffer groove 1513*a*, and the first bypass hole 151*b*1 may be referred to as a "first bypass portion BP1", and the second valve fixing groove 1512*b*, the second valve buffer groove 1513*b*, and the second bypass hole 151*b*2 may be referred to as a "second bypass portion BP2". The first bypass portion BP1 and the second bypass portion BP2 may be disposed such that a center line of the first bypass portion BP1 and a center line of the second bypass portion BP2 are parallel to each other.

In addition, the first bypass portion BP1 and the second bypass portion BP2 may be disposed with the exhaust port 151*a* interposed therebetween. Accordingly, the exhaust port 151*a* may be located between the first valve fixing groove 1512*a* and the second valve fixing groove 1512*b*, between the first valve buffer groove 1513*a* and the second valve buffer groove 1513*b*, or between the first bypass hole 151*b*1 and the second bypass hole 151*b*2.

Referring to FIGS. 3 and 4, the discharge guide groove 1515 may be provided in or at a periphery of the exhaust port 151*a*. The discharge guide groove 1515 may be axially recessed from the upper surface 150*a* of the non-orbiting end plate 151 toward a lower surface (not shown) at an opposite side by a predetermined depth. The discharge guide groove 1515 may have a long groove shape when projected in a plane.

For example, the discharge guide groove 1515 may be formed in a long groove shape having lateral (side) surfaces in a major-axis direction (hereinafter, "first major-axis lateral surface" 1515*a*) and lateral surfaces in a minor-axis direction (hereinafter, "first minor-axis lateral surface" 1515*b*).

The first major-axis lateral surfaces 1515*a* may be formed as a curved surface. The first major-axis lateral surfaces 1515*a*, each having a semicircular shape recessed outward in the radial direction, may be symmetrical with respect to the exhaust port 151*a*. Accordingly, the two first major-axis lateral surfaces 1515*a* facing each other may be curved toward opposite directions.

Further, the first long-axis side surfaces 1515*a* may have a same curvature, but may not necessarily have the same curvature. For example, the two first major-axis lateral surfaces 1515*a* may have different curvatures, or one of the first major-axis lateral surfaces 1515*a* may be formed as a straight surface.

Alternatively, the curvature of the first major-axis lateral surface 1515*a* may be substantially equal to a curvature of the exhaust port 151*a*, and thus, a distance from the exhaust port 151*a* to the first major-axis lateral surfaces 1515*a* in the major-axis direction may be constant. Then, refrigerant discharged from the exhaust port 151*a* uniformly passes through the discharge guide groove 1515, thereby reducing flow resistance in the discharge guide groove 1515.

However, the curvature of the first major-axis lateral surface 1515*a* is not necessarily the same as the curvature of the exhaust port 151*a*. For example, the curvature of the first major-axis lateral surface 1515*a* may be smaller than the curvature of the exhaust port 151*a*. In this case, lateral surfaces in the major-axis direction of the discharge guide groove 1515 may be wide, allowing the discharge guide groove 1515 to have a wider cross-sectional area.

In addition, the discharge guide groove 1515 communicates with the intermediate exhaust port 163*a* of the back pressure plate 161 described hereinafter. A maximum length of the discharge guide groove 1515 may be greater than an inner diameter connecting an inner circumferential surface of the intermediate exhaust port 163*a*, and equal to or less than an outer diameter connecting an outer circumferential surface of the intermediate exhaust port 163*a*.

In other words, the first major-axis lateral surface 1515*a* may radially overlap the intermediate exhaust port 163*a*. Accordingly, refrigerant discharged through the exhaust port 151*a* may quickly flow to the intermediate exhaust port 163*a* along the first major-axis lateral surface 1515*a* of the discharge guide groove 1515, and then discharged to the discharge space 112 through the intermediate exhaust port 163*a*.

In addition, the first major-axis lateral surface 1515*a* may extend perpendicular to the bottom surface 1515*c*. However, when the first major-axis lateral surface 1515*a* is formed as a vertical plane, flow resistance may be increased accordingly.

Thus, the first major-axis lateral surface 1515*a* may be inclined such that a cross-sectional area thereof is wider toward the upper surface 150*a* of the non-orbiting scroll 150 from the bottom surface 1515*c* of the discharge guide groove 1515. This may allow the refrigerant discharged from the exhaust port 151*a* to be smoothly discharged. In this embodiment, both the first major-axis lateral surfaces 1515*a* of the discharge guide groove 1515 are inclined such that the cross-sectional area of the discharge guide groove 1515 is increased (wider) in an upward direction.

Although not shown in the drawings, the first minor-axis lateral surfaces 1515*b* may be formed such that a cross-sectional area thereof is wider toward the upper surface 150*a* of the non-orbiting scroll 150 from the bottom surface 1515*c* of the discharge guide groove 1515. In this case, however, a sealing distance between the discharge guide groove and the bypass hole accommodating groove is decreased, and thus, an inclination angle of the first minor-axis lateral surface 1515*b* may be less than that of the first major-axis lateral surface 1515*a*. Although not illustrated in the drawings, the first major-axis lateral surface 1515*a* may have a wedge shape, or be formed as a straight surface.

The first minor-axis lateral surface 1515*b* may be formed as a straight surface when projected in a plane. Accordingly, the two first minor-axis surfaces 1515*b* may be parallel to each other. Then, the cross-sectional area of the discharge guide groove 1515 is as wide as possible to minimize flow resistance at an outlet side of the exhaust port 151*a*. This may allow a refrigerant in the compression chamber to be more quickly discharged.

In addition, the first minor-axis lateral surface 1515*b* may be parallel to lateral surfaces in a minor axis direction (hereinafter, "second minor-axis lateral surfaces 1514*a*2 and 1514*b*2") of neighboring first and second bypass hole accommodating grooves 1514*a* and 1514*b*. Accordingly, a maximum area of the discharge guide groove 1515 may be achieved while securing a sealing distance between the discharge guide groove 1515 and the bypass hole accommodating groove 1514*a*, and between the discharge guide groove 1515 and the bypass hole accommodating groove 1514*b*.

However, the two first lateral surfaces in the minor direction 1515*b* are not necessarily parallel to each other. For example, a gap between the two first minor axis lateral surfaces 1515*b* may vary along the major axis direction.

In this case, a sealing distance between the bypass valve 171 and the bypass hole accommodating groove 1514*a* in which an opening and closing portion is located, and a sealing distance between the bypass valve 172 and the bypass hole accommodating groove 1514*b* in which an opening and closing portion is located should be achieved. Thus, of both ends of the discharge guide groove 1515 in the major axis direction, a first end at which each of the opening and closing portions of the respective bass pass valves 171 and 172 is located may be narrow, and a second end at which each of the valve fixing grooves 1512*a* and 1512*b* is located may be wide.

In addition, the first minor axis lateral surface 1515*b* is not necessarily formed as a straight surface. For example, the first minor axis lateral surface 1515*b* may be formed as a curved surface recessed radially outward. In this case, a curvature of the first minor axis lateral surface 1515*b* may be smaller than a curvature of the first major axis lateral surface 1515*a*.

In addition, the first minor-axis lateral surface 1515*b* may be formed as an inclined surface, like the first major axis lateral surface 1515*a*. An inclination angle of the first minor axis lateral surface 1515*b* may be equal to an inclination angle of the first major axis lateral surface 1515*a*. This may allow refrigerant discharged from the exhaust port 151*a* to be quickly guided to the intermediate exhaust port 163*a*.

Further, as the discharge guide groove 1515 is provided in a vicinity the exhaust port 151*a*, an axial length of the exhaust port 151*a* (used interchangeably with a length of the exhaust port, for the sake of convenience) may be less (or shorter) than an axial length of the non-orbiting end plate 151 (used interchangeably with a thickness of the non-orbiting end plate, for the sake of convenience). Accordingly, a volume of the exhaust port 151*a* may be reduced, which allows a dead volume at the exhaust port 151*a* to be reduced, thereby improving compressor efficiency.

That is, as for the scroll compressor, as the orbiting wrap 142 performs an orbiting motion, a refrigerant flows from the intermediate pressure chamber to the discharge pressure chamber, and is then discharged through the exhaust port 151*a*. When the orbiting wrap 142 passes by the exhaust port 151*a*, a refrigerant remaining in the exhaust port 151*a*, as it was not discharged from the preceding compression chamber, flows back to the following compression chamber.

Then, over compression occurs in the following compression chamber due to the refrigerant flowing back thereinto, which will eventually lead to increased damage of the motor. Therefore, a smaller volume of the exhaust port 151*a* is more suitable for reducing the dead volume.

In order to decrease the volume of the exhaust port 151*a*, the inner diameter of the exhaust port 151*a* may be reduced, or a length of the exhaust port 151*a* may be reduced. However, when shapes of the orbiting wrap 142 and the non-orbiting wrap 153 are determined, the inner diameter of the exhaust port 151*a* is determined together with a discharge start angle, making it difficult to change the inner diameter of the exhaust port 151*a*. Accordingly, a decrease in the length of the exhaust port 151*a* may be more suitable for reducing the volume of the exhaust port 151*a*.

If the length of the exhaust port 151*a* is too short, a thickness of the non-orbiting end plate 151 is too thin to withstand pressure of the discharge pressure chamber. Then, the non-orbiting end plate 151 may be deformed by the pressure of the discharge pressure chamber. Therefore, the length of the exhaust port 151*a* may be determined such that the thickness of the non-orbiting end plate 151 is sufficient to withstand the pressure of the discharge pressure chamber without being deformed. For example, the length of the exhaust port 151*a* may be more than ½ of the thickness of the non-orbiting end plate 151, which is suitable in terms of stability of the non-orbiting end plate 151.

In addition, a scroll-side back pressure hole (hereinafter, "first back pressure hole 151*c*") that communicates with a plate-side back pressure hole (hereinafter, "second back pressure hole 162*a*"), which will be described hereinafter, may be provided in the non-orbiting end plate 151. The first back pressure hole 151*c* may communicate with the compression chamber V having an intermediate pressure, which is pressure between a suction pressure and a discharge pressure.

In addition, a plurality of guide protrusions 154 may be formed on an outer circumferential surface of the non-orbiting side wall 152 along the circumferential direction. Each of the plurality of guide holes 154*a* may be formed in the guide protrusions 154, respectively.

A back pressure chamber assembly 160 according to this embodiment may be installed on or at an upper portion of the non-orbiting scroll 150. Accordingly, the non-orbiting scroll 150 may be pressed in a direction toward the orbiting scroll 140 by a back pressure of a back pressure chamber S (more precisely, a back pressure force acts on the back pressure chamber) to seal the compression chamber V.

The back pressure chamber assembly 160 may include a back pressure plate 161 coupled to the upper surface 150*a* of the non-orbiting scroll (or non-orbiting end plate) 150, and a floating plate 165 slidingly coupled to the back pressure plate 161 so as to form the back pressure chamber S, together with the back pressure plate 161. The back pressure plate 161 may be fastened to the upper surface 150*a* of the non-orbiting scroll (or non-orbiting end plate) 150 by a plurality of bolts (not shown) along the circumferential direction. The plurality of bolts (not shown) may penetrate through the back pressure plate 161 inside the back pressure chamber S to be fastened to the non-orbiting end plate 151.

The back pressure plate 161 may include a support plate 162 in contact with the non-orbiting end plate 151. The support plate 162 may have an annular plate shape with a hollow (or empty) center, and may be provided with second back pressure hole 162*a* that communicates with the first back pressure hole 151*c* penetrating in the axial direction. The second back pressure hole 162*a* may communicates with the back pressure chamber S. Accordingly, the second back pressure hole 162*a* together with the first back pressure hole 151*c* may provide communication between the compression chamber V and the back pressure chamber S.

A first annular wall 163 and a second annular wall 164 may be provided on an upper surface of the support plate 162 to surround inner and outer circumferential surfaces of the support plate 162. An outer circumferential surface of the first annular wall 163, an inner circumferential surface of the second annular wall 164, the upper surface of the support plate 162, and a lower surface of the floating plate 165 may define the back pressure chamber S with an annular shape. The first annular wall 163 may be provided with intermediate exhaust port 163*a* that communicates with the exhaust port 151*a* of the non-orbiting scroll 150. A valve guide groove 163*b* into which a check valve (hereinafter, "discharge valve 173") may be slidingly inserted may be provided inside of the intermediate exhaust port 163*a*. The discharge valve 173 may selectively open and close the exhaust port 151*a* and the intermediate exhaust port 163*a* to prevent discharged refrigerant from flowing back into the compression chamber.

The floating plate 165 having an annular shape may be made of a lightweight material, which is lighter than the back pressure plate 161. Accordingly, the floating plate 165 may be attached to and detached from a lower surface of the high-low pressure separating plate 115 while axially moving with respect to the back pressure plate 161 according to pressure of the back pressure chamber S. For example, when the floating plate 165 is brought into contact with the high-low pressure separating plate 115, it plays a role of sealing, so that discharged refrigerant is discharge to the discharge space 112 without being leaked into the suction space 111.

In the drawings, unexplained reference numerals 1183 and 163*c* denote an orbiting bearing configured as a bush bearing and a backflow prevention hole, respectively.

The scroll compressor according to embodiments may operate as follows.

That is, the rotor 122 may rotate when power is applied to the coil 121*a* of the stator 121, and the rotational shaft 125 coupled to the rotor 122 may rotate together with the rotor 122. Then, the orbiting scroll 140 coupled to the rotational shaft 125 may perform an orbiting motion with respect to the non-orbiting scroll 150, forming a pair of compression chambers V between the orbiting wrap 142 and the non-orbiting wrap 153. As the orbiting scroll 140 performs the orbiting motion, the pair of compression chambers V moves from the outside to the inside, leading to a decrease in volume. Accordingly, a refrigerant suctioned into the suction space 111 of the casing 110 may be introduced into the respective compression chambers V to be compressed.

At this time, a portion (or some) of the compressed refrigerant flows to the back pressure chamber S through the first back pressure hole 151*c* and the second back pressure hole 162*a* before reaching the exhaust port 151*a*. Accordingly, the back pressure chamber S defined by the back pressure plate 161 and the floating plate 165 forms an intermediate pressure.

Then, the floating plate 165 is pressed upward and is brought into close contact with the high-low pressure separating plate 115. Then, the discharge space 112 and the suction space 111 of the casing 110 are separated, thereby preventing refrigerant discharged to the discharge space 112 from being leaked into the suction space 111. At this time, the back pressure plate 161 is pressed downward to pressurize the non-orbiting scroll 150 in a direction toward the orbiting scroll 140. As the non-orbiting scroll 150 is brought into close contact with the orbiting scroll 140, a gap between the compression chambers V is sealed, thereby preventing refrigerant from leaking into the low-pressure side compression chamber from the high-pressure side compression chamber.

A refrigerant in the compression chamber may flow to the discharge pressure chamber (not shown) while being compressed in the intermediate pressure chamber (not shown), and a portion of the refrigerant flowing from the intermediate pressure chamber to the discharge pressure chamber may be bypassed to the discharge space 112 from the respective intermediate chambers through the first bypass hole 151*b*1 and the second bypass hole 151*b*2 before reaching the discharge pressure chamber. Then, the refrigerant having flowed to the discharge pressure chamber may be discharged to the discharge space 112 through the exhaust port 151*a*.

In the scroll compressor according to this embodiment, an Oldham ring, which is an anti-rotation member, may be installed between the main frame and the orbiting scroll. The Oldham ring may be slidingly coupled to the first key groove provided in the orbiting scroll and be slidingly coupled to the second key groove provided in the non-orbiting scroll. The Oldham ring allows the orbiting scroll to orbit with respect to the non-orbiting scroll.

Figure 5:
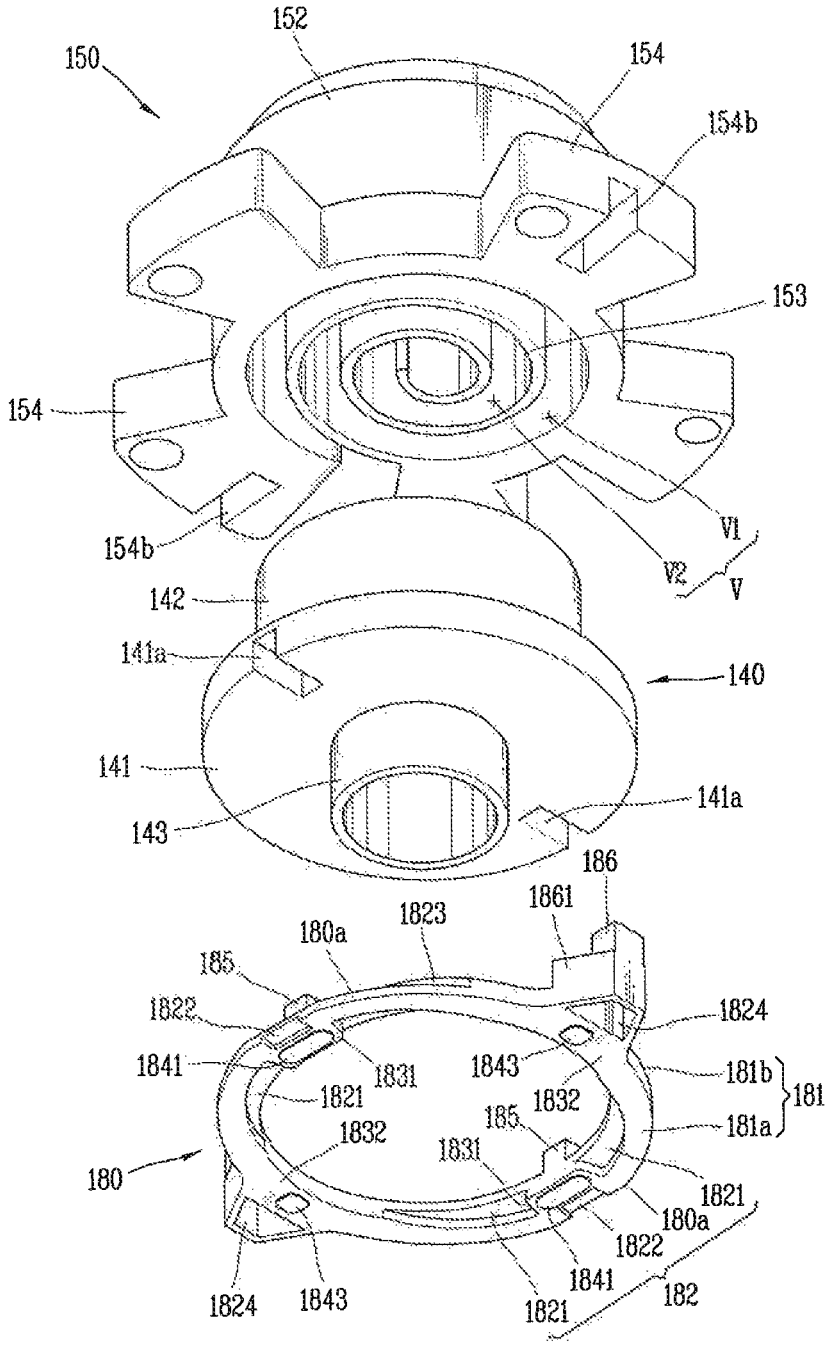
FIG. 5 is a perspective view of an orbiting scroll and a non-orbiting scroll separated from a frame in the scroll compressor according to an embodiment, viewed from the bottom.

FIG. 5 is a perspective view of an orbiting scroll and a non-orbiting scroll separated from a frame in the scroll compressor according to an embodiment, viewed from the bottom. Referring to FIG. 5, in the orbiting scroll 140 described above, the plurality of first key grooves 141*a* is formed on the lower surface of the orbiting end plate 141. The plurality of first key grooves 141*a* having a rectangular shape radially extends from the outer circumferential surface of the orbiting end plate 141 by a predetermined length. The plurality of first key grooves 141*a* may have a phase difference of approximately 180° along the circumferential direction.

In the non-orbiting scroll 150 described above, the plurality of guide protrusions 154 may be provided on the outer circumferential surface of the non-orbiting scroll side wall 152 in the circumferential direction. The second key groove 154*b* may be provided on the plurality of guide protrusions 154, respectively. The guide hole 154*a* may be provided on or at one side of the second key grooves 154*b* in the circumferential direction, respectively. The plurality of second key grooves 154*b* having a rectangular shape may radially extend from the outer circumferential surface of the guide protrusion 154 by a predetermined length. The plurality of second key grooves 154*b* may have a phase difference of approximately 180° along the circumferential direction.

The Oldham ring 180 may be made of an aluminum material or a material having properties equivalent to the aluminum material, for example. In this embodiment, however, description will be given of the Oldham ring 180 made of the aluminum material. Accordingly, a weight of the Oldham ring 180 may be reduced, thereby improving motor efficiency and compressor performance.

However, aluminum may be vulnerable to a twisting (or torsional) moment due to its material property. Accordingly, deformation, such as twisting, may occur in the ring 181 of the Oldham ring 180 during operation of the compressor. Then, friction between the keys 185 and 186 extending from the ring 181 of the Oldham ring 180 and the key grooves 141*a* and 154*b* into which the keys 185 and 186 are slidingly inserted. As a result, efficiency of the motor and compressor performance may be decreased, and reliability of the Oldham ring 180 may be deteriorated.

In order to suppress this, the Oldham ring 180 according to this embodiment may be provided with a kind of reinforcing (or reinforcement) portion 180*a* to suppress twisting of the ring 181. However, due to the reinforcing portion 180*a*, a weight of the Oldham ring 180 increases, which may result in decreased motor efficiency and compressor performance. Because of such a problem, the Oldham ring 180 including the reinforcing portion 180*a* may have a weight (or thickness)-reduced portion 182 to reduce the weight while suppressing deformation.

Figure 6:
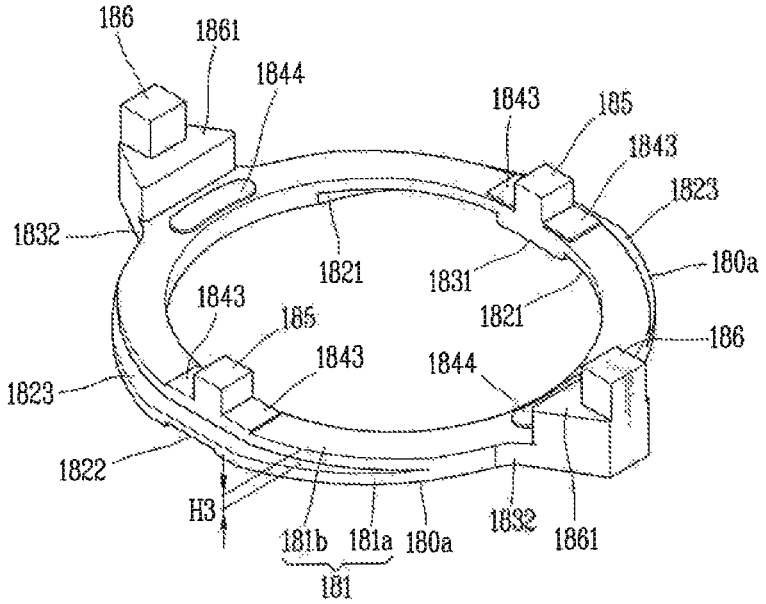
FIGS. 6 and 7 are perspective and planar views illustrating an Oldham ring in FIG. 5, viewed from above.
Figure 7:
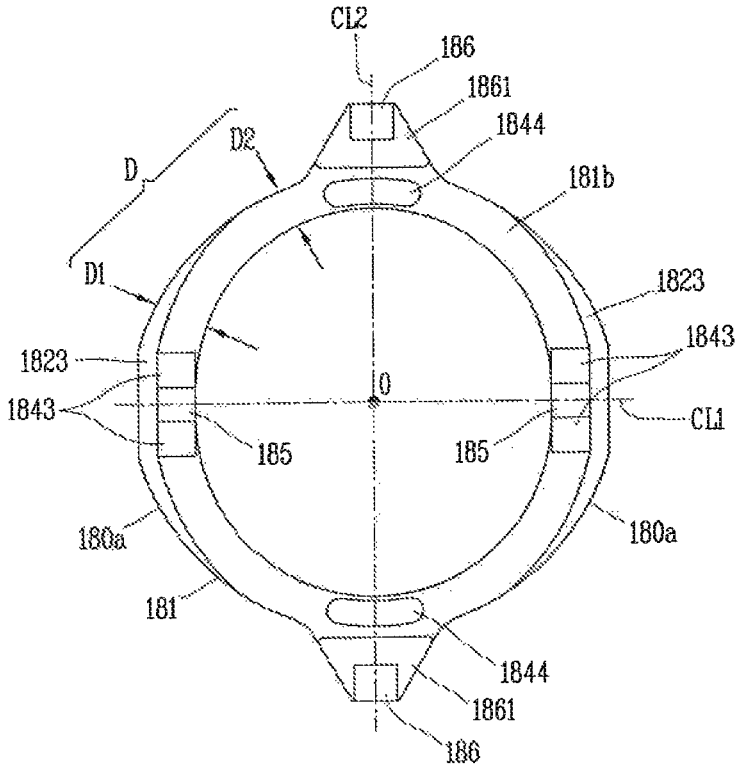
Figure 8:
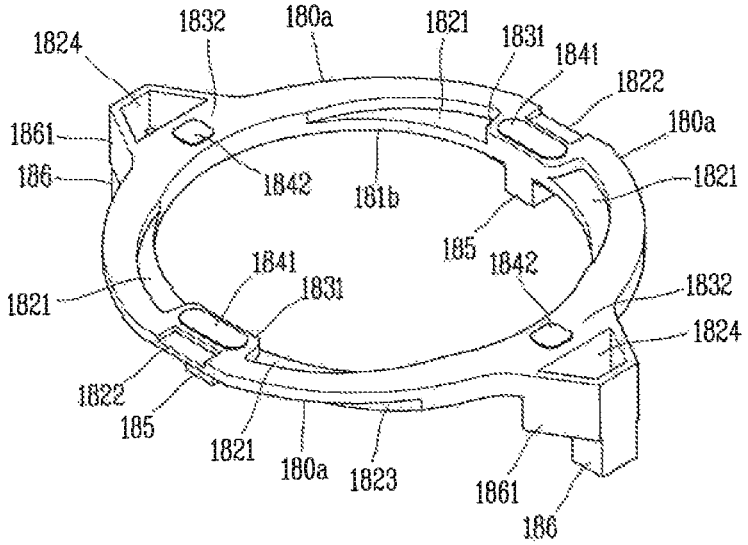
FIGS. 8 and 9 are perspective and bottom views illustrating the Oldham ring in FIG. 5, viewed from the bottom.
Figure 9:
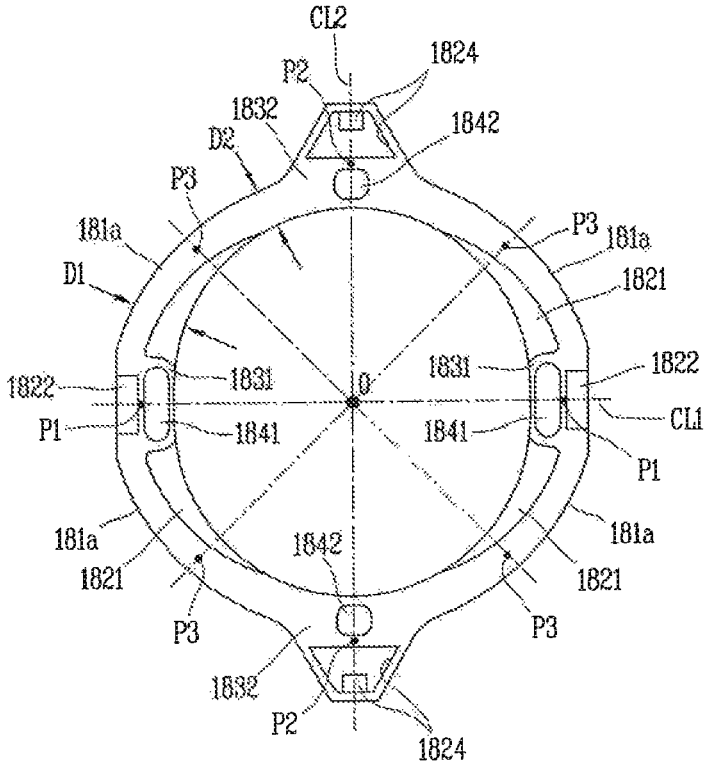

FIGS. 6 and 7 are perspective and planar views illustrating an Oldham ring in FIG. 5, viewed from above. FIGS. 8 and 9 are perspective and bottom views illustrating the Oldham ring in FIG. 5, viewed from the bottom.

Referring to these drawings, the Oldham ring 180 according to this embodiment may include the ring 181 having an annular shape, and the first key 185 and the second key 186 extending from the ring 181, respectively. The first key 185 and the second key 186 may extend from a same surface of both surfaces of the ring 181 in the axial direction, namely, axially extend from an upper surface of the ring 181. The first key 185 may be slidingly inserted into the first key groove 141*a* of the orbiting scroll 140, and the second key 186 may be slidingly inserted into the second key groove 154*b* of the non-orbiting scroll 150.

An axial thickness (hereinafter, thickness t") of the ring 181 according to this embodiment may be the same overall, and a radial width D of the ring portion 181 may vary along the circumferential direction. For example, considering that a lateral (side) force received by the first key 185 is greater than a lateral force received by the second key 186, a radial width D1 around the first key 185 is greater than a radial width D2 around the second key 186.

Referring to FIGS. 7 and 9, in the ring 181 according to this embodiment, the radial width D1 at a point (or portion) through which a first virtual line CL1 passes is greater than the radial width D2 at a point through which a second virtual line CL2 passes. Hereinafter, the first virtual line CL1 denotes a virtual line that connects the plurality of first keys 185 to each other, and the second virtual line CL2 denotes a virtual line that connects the plurality of second keys 186 to each other.

For example, the radial width D1 of the ring 181 may be gradually increased toward the first virtual line CL1 with respect to the second virtual line CL2. Accordingly, as described above, the ring 181 may be formed such that the radial width D1 around the first key 185 is greater than the radial width D2 around the second key 186.

As such, when the radial width D of the ring 181 increases in the vicinity of the first key 185, the ring 181 may be prevented from being twisted even if a twisting moment around the first key 185 increases. However, when the radial width D1 of the ring 181 increases in the vicinity of the first key 185, a weight of the Oldham ring 180 including the ring 181 may increase.

To prevent this, weight-reduced portion 182 may be provided at the ring 181. At least one of the lower surface and the upper surface of the ring portion 181 may be provided with the weight-reduced portion 182. Then, the radial width D of the ring portion 181 is increased, and thus, rigidity enough to withstand the twisting moment may be achieved while preventing the weight of the Oldham ring 180 from being excessively increased.

Figure 10:
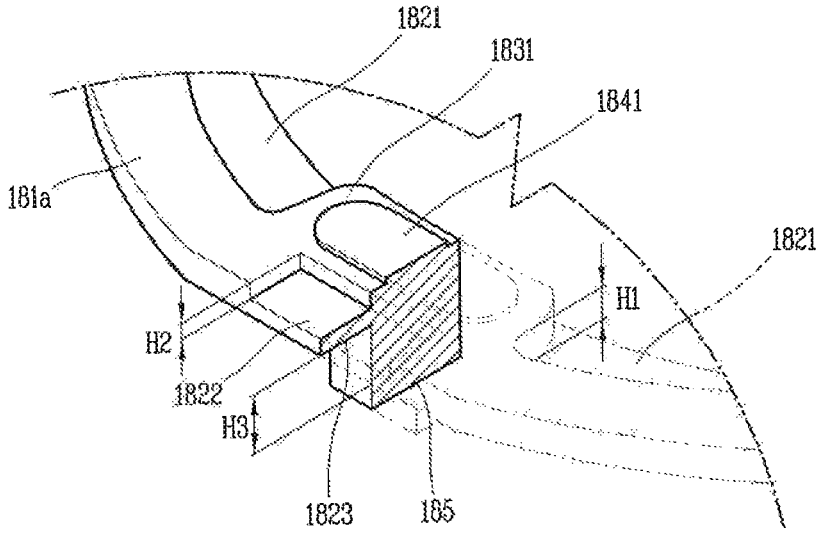
FIG. 10 is a perspective view illustrating a weight-reduced portion, cut from the bottom, in accordance with an embodiment.

FIG. 10 is a perspective view illustrating one example of a weight-reduced portion, cut from the bottom, in accordance with an embodiment. Referring to FIG. 10, in the Oldham ring 180 according to this embodiment, a plurality of first weight-reduced portions 1821 may be provided on one surface of the ring 181 facing the main frame 130. When the lower surface of the ring 181 facing the main frame 130, of both surfaces of the ring 181 in the axial direction, is referred to as a first surface 181*a*, and the upper surface at the opposite side, is referred to a second surface 181*b*, the first weight-reduced portions 1821 may be provided at the first surface 181*a*.

The plurality of first weight-reduced portions 1821 according to this embodiment may be recessed from an inner circumferential surface of the ring 181 by a predetermined depth and width in the axial and radial directions, respectively. Alternatively, the plurality of first weight-reduced portions 1821 may be recessed from an outer circumferential surface of the ring 181 by a predetermined depth and width in the axial and radial directions, respectively.

In addition, although not shown in the drawing, the plurality of first weight-reduced portions 1821 may be stepped to have multiple steps. Or each of the plurality of first weight-reduced portions 1821 may be recessed between the inner and outer circumferential surfaces of the ring 181.

As illustrated in FIG. 9, each of the plurality of first weight-reduced portions 1821 may be provided between each of the first keys 185 and the second keys 186. In other words, each of the plurality of first weight-reduced portions 1821 may be provided between each of first points P1 where the first virtual line CL1 passes through the ring 181 and second points P2 where the second virtual line CL2 passes through the ring 181.

Each of the plurality of first weight-reduced portions 1821 may be provided between each of the first points P1 and the second points P2 along the circumferential direction to have the same dimensions. However, as the radial width of the ring 181 varies along the circumferential direction, the dimensions of each of the first weight-reduced portions 1821 may also vary along the circumferential direction.

For example, with respect to a third point P3, which is an intermediate point between the first point P1 and the second point P2, the plurality of first weight-reduced portions 1821 may be located eccentrically toward the respective first points P1. Accordingly, a cross-sectional area of the respective first weight-reduced portions 1821 may be wider toward the first points (first virtual line) P1 where the radial width D of the ring 181 is wide. This may reduce weight imbalance of the ring 181, which is due to the radial width D of the ring 181 is increased around the first key 185, to a certain extent.

An axial depth H1 of each of the first weight-reduced portions 1821 may be equal. However, the axial depth H1 of each of the first weight-reduced portions 1821 may vary along the circumferential direction. For example, the axial depth H1 of each of the first weight-reduced portions 1821 may be deeper (or increased) toward the respective first keys 185. However, in consideration of rigidity of the ring 181, a maximum axial depth H1 of each of the first weight-reduced portions 1821 should be ½ to ⅔ of an axial thickness t of the ring 181.

In addition, each of the first weight-reduced portions 1821 may have an equal radial width W1 along the circumferential direction of the ring 181. However, the radial width W1 of each of the first weight-reduced portions 1821 may vary along the circumferential direction.

For example, the radial width W1 of each of the first weight-reduced portions 1821 may be deeper toward the respective first keys 185. However, in consideration of rigidity of the ring 181, a maximum axial depth H1 of each of the first weight-reduced portions 1821 should be ½ to ⅔ compared to the axial thickness t of the ring 181.

Referring to FIG. 10, a plurality of first key supports 1831 may be provided on the first surface 181*a* of the ring 181 according to this embodiment. Each of the plurality of first key supports 1831 may be provided between ends of one side in the circumferential direction of the first weight-reduced portions 1821 facing the first virtual line CL1, respectively. As the first key support 1831 according to this embodiment is provided at a position where the first key 185 is formed, the plurality of first key supports 1831 may have a phase difference of approximately 180°. As the plurality of first key supports 1831 is located within a range of the ring 181, the plurality of first key supports 1831 substantially defines a portion of the ring 181.

In addition, a first axial support surface 121 may be provided on the plurality of first key supports 1831, respectively. The first axial support surface 1841 may axially protrude from a lower surface of the first key support 1831 by a predetermined height. The height of the first axial support surface 1841 may be significantly lower than the axial thickness of the ring 181.

The plurality of first key supports 1831 may be symmetrical with respect to the second virtual line CL2, and the first axial support surfaces 1841 may be symmetrical with respect to the second virtual line CL2. Hereinafter, for the sake of convenience, one first key support 1831 and one first axial support surface 1841 will be used as representative examples.

Figure 11:
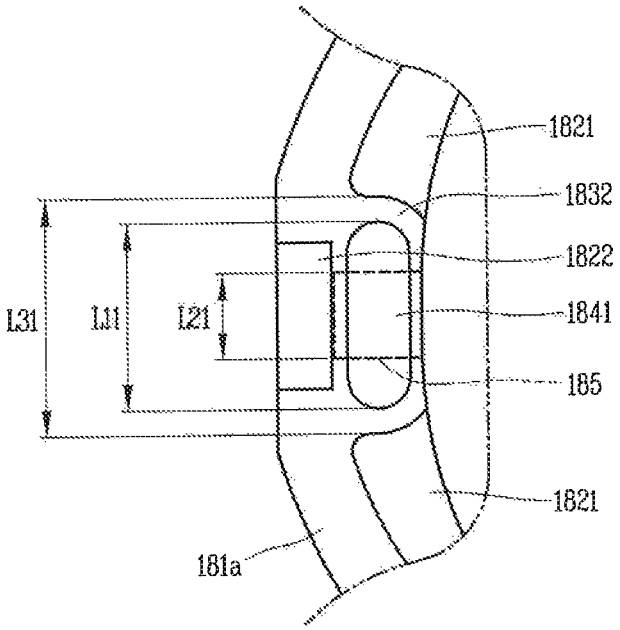
FIG. 11 is an enlarged bottom view illustrating a first key support in FIG. 10.
Figure 12:
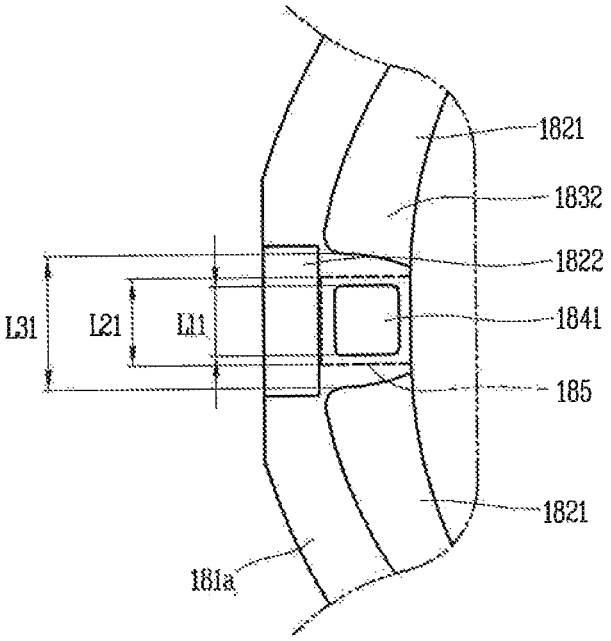
FIG. 12 is a perspective view illustrating another example of a first axial support surface according to an embodiment.

FIG. 11 is an enlarged bottom view illustrating a first key support in FIG. 10. FIG. 12 is a perspective view illustrating another example of a first axial support surface according to an embodiment.

Referring to FIG. 11, each of the first keys 185 may be provided on the upper surface of the ring 181. In other words, the first key 185 may be provided in a portion of the second surface 181*b* of the ring 181 where the first key support 1831 is formed. Accordingly, each of the plurality of first key supports 1831 may be provided at a position at which at least a portion thereof overlaps the respective first keys 185 in the axial direction. Accordingly, the plurality of first axial support surfaces 1841 may be formed such that at least a portion or part thereof axially overlaps the first virtual line CL1, namely, the first virtual line CL1 passes through each of the first axial support surfaces 1841.

The plurality of first axial support surfaces 1841 may be formed such that a circumferential length L11, which is in a major axis direction, is greater than a circumferential length L21 of the first key 185. That is, when a direction orthogonal to a sliding direction of the first key 185 is referred to as a 'first direction', and a direction orthogonal to the first direction is referred to as a 'second direction', the first direction length L11 of the first axial support surface 1841 may be longer than the first direction length L21 of the first key 185.

As described above, when the first direction length L11 of each of the first axial support surfaces 1841 is longer than the first direction length L21 of each of the first keys 185, an axial support area for the Oldham ring 180 is increased. Accordingly, a behavior of the Oldham ring 180 and the orbiting scroll 140 may be stabilized.

However, in an embodiment of FIG. 12, the first direction length L11 of each of the first axial support surfaces 1841 may be equal to or lower than the first direction length L21 of each of the first keys 185. In this case, as the first direction length L11 of the first axial support surface 1841 is decreased, a circumferential length L31 of the first key support 1831 may also be reduced. Then, as the circumferential length L31 of the first key support 1831 is reduced, a circumferential length of the first weight-reduced portion 1821 increases, thereby increasing a cross-sectional area of the first weight-reduced portion 1821. As a result, a weight of the Oldham ring 180 may be further reduced.

Referring to back to FIGS. 5, 6, and 10, a second weight-reduced portion 1822 may be provided on or at one radial side of the plurality of first axial support surfaces 1841, respectively. For example, the plurality of second weight-reduced portions 1822 may be located radially outward than the respective first axial support surfaces 1841. The plurality of second weight-reduced portions 1822 may be recessed from the outer circumferential surface of the ring 181 toward a center by a predetermined depth and width, as opposed to the respective first weight-reduced portions 1821.

An axial depth H2 of each of the second weight-reduced portions 1822 may be approximately similar to or less than the axial depth H1 of each of the first weight-reduced portions 1821. A plurality of third weight-reduced portions 1823 described hereinafter may axially overlap the plurality of second weight-reduced portions 1822. Accordingly, an axial depth H3 of the third weight-reduced portion 1823 may be too shallow when the third weight-reduced portions 1823 are too deep. Then, the depth H3 of the plurality of third weight-reduced portions 1823 having a relatively wide cross-sectional area compared to the plurality of second weight-reduced portions 1822 is decreased, so that a volume of the weight-reduced portions overall may be reduced. Thus, the depth H2 of each of the second weight-reduced portions 1822 may be less than the depth H1 of each of the first weight-reduced portions 1821.

In addition, the plurality of second weight-reduced portions 1822 may have an equal radial depth W2 along the circumferential direction. This is because the plurality of first axial support surfaces 1841 is longer in the first direction orthogonal to the first virtual line CL1. Accordingly, each of the second weight-reduced portions 1822 may also be elongated in the first direction corresponding to the first axial support surfaces 1841.

Figure 13:
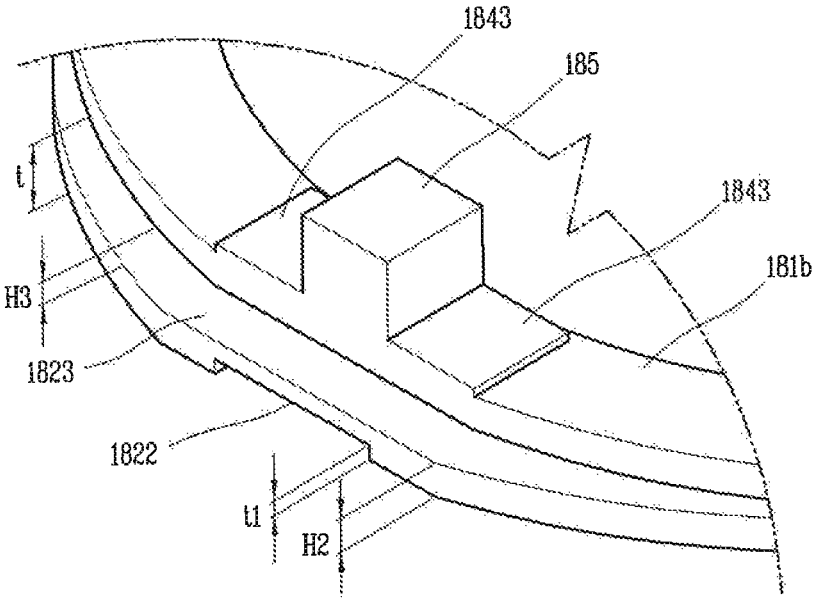
FIG. 13 is a perspective view illustrating another example of a weight-reduced portion, cut from above, in the Oldham ring according an embodiment.
Figure 14:
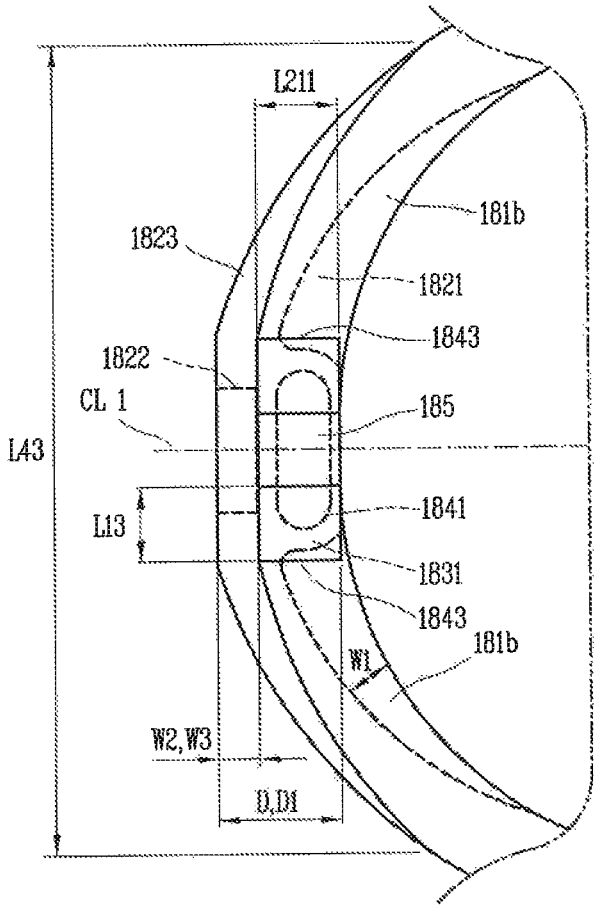
FIG. 14 is an enlarged planar view illustrating the first key support in FIG. 13.

In the ring according to this embodiment, the second surface thereof may also be provided with a weight-reduced portion. FIG. 13 is a perspective view illustrating another example of a weight-reduced portion, cut from the above, in the Oldham ring according an embodiment. FIG. 14 is an enlarged planar view illustrating a first key support in FIG. 13.

Referring to FIGS. 13 and 14, the plurality of third weight-reduced portions 1823 may be provided on the second surface 181*b* of the ring 181 according to this embodiment. Each of the plurality of third weight-reduced portions 1823 is recessed from the outer circumferential surface of the ring 181 toward the center, unlike the respective first weight-reduced portions 1821, by a predetermined depth and width.

The axial depth H3 of the plurality of third weight-reduced portions 1823 may be approximately similar to the axial depth H1 of the respective first weight-reduced portions 1821. However, as each of the third weight-reduced portions 1823 overlaps the respective first weight-reduced portions 1821 in the circumferential direction, the plurality of third weight-reduced portions 1823 may not overlap the respective first weight-reduced portions 1821, which is more advantageous in terms of rigidity of the ring 181. Thus, the axial depth H3 of the third weight-reduced portions 1823 should be approximately less than ½ of the axial thickness t of the ring 181.

In addition, each of the third weight-reduced portions 1823 overlaps the respective second weight-reduced portions 1822 in the circumferential direction. In particular, as each of the third weight-reduced portions 1823 is provided on the outer circumferential surface of the ring 181 at a position at which each of the third weight-reduced portions 1823 overlaps the respective first keys 185 in the circumferential direction, as in the case of the second weight-reduced portions 1822. Accordingly, each of the plurality of third weight-reduced portions 1823 is formed such that the second weight-reduced portion 1822 is fully accommodated in the third weight-reduced portions 1823, respectively, in the circumferential direction.

Accordingly, when the axial depth H3 of the third weight-reduced portions 1823 is too deep, an axial distance t1 from the respective second weight-reduced portion 1822 becomes too narrow, leading to a decrease in reliability. However, when the axial depth H3 of the third weight-reduced portions 1823 is too shallow, it is disadvantageous in terms of weight reduction of the Oldham ring 180. Thus, the axial depth H3 of the third weight-reduced portions 1823 may be as deep as possible within a range capable of maintaining rigidity of the ring 181.

For example, the axial depth H3 of the third weight-reduced portions 1823 may be equal to or less than the axial depth H2 of the second weight-reduced portion 1822. However, in consideration of the fact that cross-sectional areas of the third weight-reduced portions 1823 are greater than cross-sectional areas of the second weight-reduced portions 1822, it is more advantageous to reduce weight when the axial depth H3 of the weight-reduced portions 1823 is greater than the axial depth H2 of the second weight-reduced portions 1822.

Referring to FIG. 14, a radial width W3 of the third weight-reduced portions 1823 may vary along the circumferential direction. For example, considering that the radial width D of the ring 181 is wider toward the first virtual line (or the first point) CL1, the radial width W3 of the plurality of third weight-reduced portions 1823 may also be wider toward the first virtual line (or first point) CL1 corresponding to the radial width D of the ring 181. The plurality of third weight-reduced portions 1823 may be symmetrical with respect to the first virtual line CL1.

In the Oldham ring 180 according to embodiments, as the plurality of second keys 186 extends radially and axially from the outer circumferential surface of the ring 181 and is coupled to the non-orbiting scroll 150, respectively, an axial length L222 of the second keys 186 becomes longer. As weight of the Oldham ring 180 increases due to the plurality of second keys 186, a weight-reduced portion may also be provided at each of the second keys 186.

Figure 15:
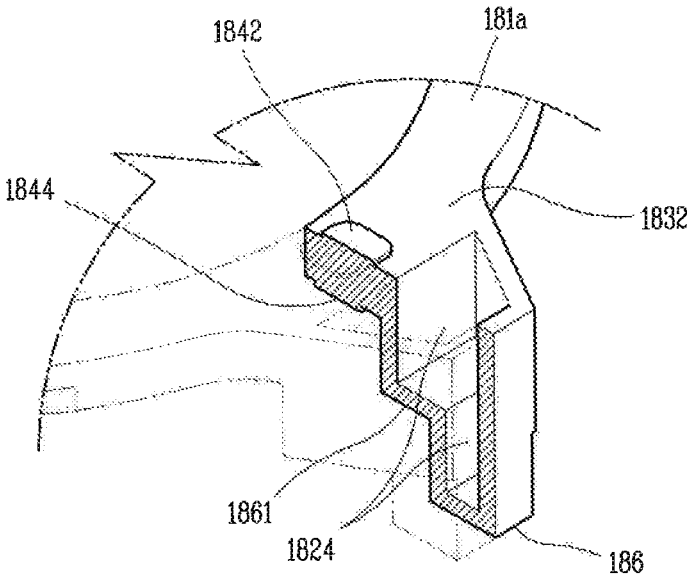
FIG. 15 is a perspective view illustrating another example of a weight-reduced portion, cut from the bottom, in the Oldham ring according to an embodiment.
Figure 16:
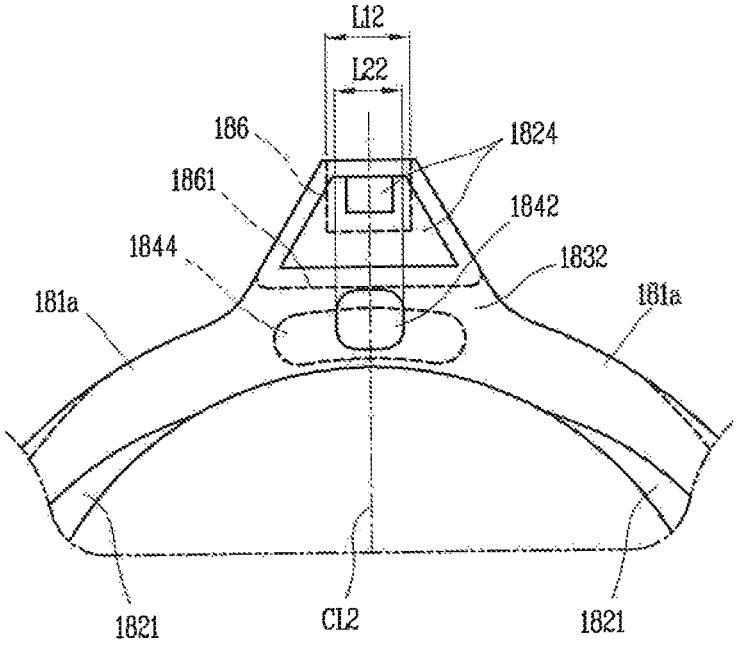
FIG. 16 is an enlarged planar view illustrating a second key support in FIG. 15.

FIG. 15 is a perspective view illustrating another example of a weight-reduced portion, cut from the bottom, in the Oldham ring according to an embodiment. FIG. 16 is an enlarged planar view illustrating a second key support in FIG. 15.

Referring back to FIGS. 8 and 9, a plurality of second key supports 1832 provided on the outer circumferential surface of the ring 181 according to this embodiment may extend in the radial direction. The plurality of second key supports 1832 may have a phase difference of approximately 180° along the circumferential direction, and be symmetrical with respect to the second virtual line CL2.

Each of the plurality of second keys 186 provided on the respective second key supports 1832 may axially extend toward the non-orbiting scroll 150. A shape of the second key support 1832 will be described hereinafter again with the second key 186.

Referring to FIG. 15, a fourth weight-reduced portion 1824 is provided at the second supports 1832, respectively. The plurality of fourth weight-reduced portions 1824 may extend from the lower surface of the ring 181, namely a lower surface of the second key support 1832 to an inside of the second key 186. Accordingly, the weight of the Oldham ring 180 may be further reduced.

Each of the plurality of fourth weight-reduced portions 1824 may have a shape corresponding to a shape of the second key support 1832. For example, as the second key support 1832 is stepped in the axial direction, the fourth weight-reduced portion 1824 may be stepped in the axial direction. That is, a key reinforcing (or reinforcement) portion 1861 described hereinafter may be provided at an upper surface of the second key support 1832 according to this embodiment, and the second key 186 may be formed on an upper surface of the key reinforcing portion 1861. In addition, a horizontal cross-sectional area of the key reinforcing portion 1861 may be wider than that of the second key 186. Accordingly, the fourth weight-reduced portion 1824 may be formed such that an area in the key reinforcing portion 1861 is greater than an area of the second key 186.

Further, a plurality of second axial support surfaces 1842 may be formed on the first surface 181*a* of the ring 181. Each of the plurality of second axial support surfaces 1842 may be provided at a position corresponding to the respective second key supports 1832 in the radial direction.

For example, as shown in FIG. 16, the plurality of second axial support surfaces 1842 may be provided between ends of the respective first weight-reduced portions 1821 facing the second virtual line CL2, each protruding toward the main frame 130 by a predetermined height. The plurality of second axial support surfaces 1842 may overlap at least a portion of the second virtual line CL2, respectively.

The plurality of second axial support surfaces 1842 may have a circumferential length L12, which is a major-axis direction, greater (longer) than a circumferential length L22 of the second key 186. That is, a sliding direction of the second key 186 may be orthogonal to the sliding direction of the first key 185. Accordingly, as described above, when a direction orthogonal to the sliding direction of the first key 185 is a first direction, a direction orthogonal to the sliding direction of the second key 186 is a second direction, and the sliding direction of the second key 186 is the first direction. A length of the second axial support surface 1842 in the second direction, which is may be equal to or greater than a length of the second key 186 in the second direction.

When the length of the plurality of second axial support surfaces 1842 in the second direction (L22) is equal to or greater than the length of the second keys 186 in the second direction (L221), an area of the axial support surface with respect to the Oldham ring 180 may be increased. This may allow behavior of the Oldham ring 180 and the orbiting scroll 140 to be stabilized.

As described above, in the Oldham ring 180 according to this embodiment, the plurality of first keys 185 and second keys 186 may be provided at the second surface 181*b* of the ring 181, each extending to the same axial direction. For example, the plurality of first keys 185 may be formed such that a longitudinal center of the first key 185 is located on the first virtual line CL1 that passes through a center O of the ring 181. The plurality of first keys 185 may be respectively provided between inner and outer circumferential surfaces of the ring 181 and have a phase difference of approximately 180° along the circumferential direction. The second key 186 described hereinafter may be provided between the first keys 185 in the circumferential direction. Accordingly, the first key 185 and the second key 186 may be alternately provided with a same interval therebetween, and the second key 186 may be interposed between the first keys 185.

Referring back to FIG. 14, the plurality of first keys 185 according to this embodiment may be formed in a rectangular shape, each extending radially between the inner and outer circumferential surfaces of the ring 181. In this case, the first key 185 may have a radial length L211 equal to the radial width D1 of the first key support 1831 of the ring 181. However, the third weight-reduced portion 1823 may be provided on an upper surface of an outer circumference of the first key support 1831 according to this embodiment, as the third weight-reduced portion 1823 passes through an outer circumferential side of the first key 185 along the circumferential direction, the first the radial length L211 of the first key 185 is less than the radial width, that is, the radial width of the ring, D1 of the first key support 1831.

Further, a third axial support surface 1843 may be provided on both surfaces of the first key 185 in the circumferential direction, respectively. The plurality of third axial support surfaces 1843 may extend from the both surfaces in the circumferential direction of the first key 185, and axially extend to protrude from the second surface 181*b* of the ring 181 by a predetermined height.

The plurality of third axial support surfaces 1843 may be formed such that a sum of each circumferential length L13 is less than a circumferential length L43 of the third weight-reduced portion 1823. Thus, the weight of the Oldham ring 180 may be prevented from being increased by the third axial support surface 1843.

Figure 17:
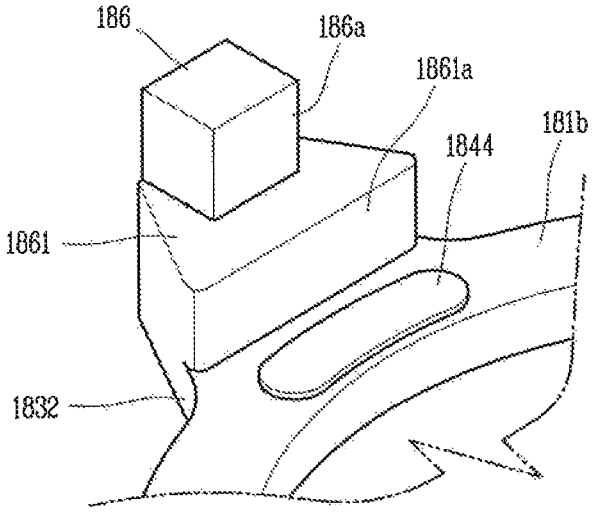
FIG. 17 is an enlarged perspective view illustrating a second key according to an embodiment.
Figure 18:
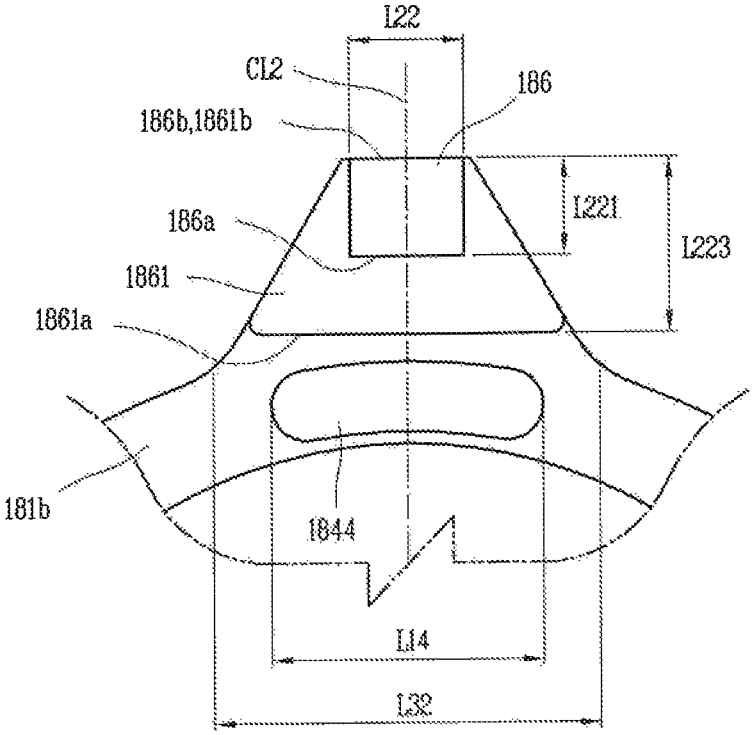
FIG. 18 is a planar view of the second key in FIG. 17.

FIG. 17 is an enlarged perspective view illustrating a second key according to an embodiment. FIG. 18 is a planar view of the second key in FIG. 17.

Referring back to FIG. 7, the plurality of second keys 186 may be formed such that a center of the second key 186 in a lengthwise direction is located on the second virtual line CL2 that passes through the center O of the ring 181. Referring to FIGS. 17 and 18, in the Oldham ring 180 according to this embodiment, each of the second key supports 1832 may radially extend from the outer circumferential surface of the ring 181, and each of the second keys 186 may axially extend from the upper surface of the respective second key supports 1832. Accordingly, the plurality of second key supports 1832 may extend from the ring 181, and functionally define a portion of the respective second keys 186.

The plurality of second key supports 1832 may have a phase difference of approximately 180° along the circumferential direction. Accordingly, the plurality of second keys 186 provided on the upper surface of the second key supports 1832 may have a phase difference of approximately 180° along the circumferential direction.

In addition, the plurality of second key supports 1832 may be formed in a trapezoidal shape in which a cross-sectional area is decreased away from the ring 181 when projected in plane. However, the cross-sectional area of the second key support 1832 may be greater than that of the second key 186 in plane projection. Accordingly, the key reinforcing portion 1861 may be further provided between the second key support 1832 and the second key 186.

The key reinforcing portion 1861 may axially extend from the upper surface of the second key support 1832, and the plurality of second keys 186 may axially extend from the upper surface of the respective key reinforcing portions

1861. The key reinforcing portion 1861 may have a shape substantially the same as the second key support 1832 when projected in a plane. For example, both side surfaces in the circumferential direction of the key reinforcing portion 1861 may extend from the second key support 1832 in a same shape, and an inner surface 1861*a* of the key reinforcing portion 1861 may be formed as a straight surface. Accordingly, the inner surface 1861*a* of the key reinforcing portion 1861 may be spaced apart from the outer circumferential surface of the ring 181, and be separated from the outer circumferential surface of the orbiting end plate 141. This may minimize collision between the Oldham ring 180 and the orbiting scroll 140.

Referring to FIG. 18, the plurality of second keys 186 may have a substantially square shape, or a rectangular shape slightly longer in the circumferential direction when projected in plane. Accordingly, a radial length L221 of the second keys 186 may be less than a radial length L223 of the key reinforcing portion 1861.

For example, an outer surface 186*b* of the second key 186 according to this embodiment may be provided in the same manner as the second key support 1832 and an outer surface 1861*b* of the key reinforcing portion 1861. On the other hand, an inner surface 186*a* of the plurality of second keys 186 may be stepped at the key reinforcing portion 1861 so as to be located further out than the inner surface 1861*a* of the key reinforcing portion 1861. As a result, a volume of the second key 186 may be reduced, thereby reducing the entire weight of the Oldham ring 180.

In addition, as the second key support 1832, the key reinforcing portion 1861, and the second key 186 extend in the axial direction in a stepped manner, as in this embodiment, the fourth weight-reduced portion 1824 may be stepped along shapes of the second key support 1832, the key reinforcing portion 1861, and the second key 186.

Referring to FIGS. 6, 17, and 18, one radial side of the key reinforcing portion 1861, namely, the second surface 181*b* of the ring 181 facing the key reinforcing portion 1861 in the radial direction may be provided with a fourth axial support surface 1844. The fourth axial support surface 1844 may protrude from the second surface 181*b* of the ring 181 by a predetermined height. The fourth axial support surface 1844 may extend to be symmetrical in the circumferential direction with respect to the second virtual line CL2.

A circumferential length L14 of the fourth axial support surface 1844 according to this embodiment may be equal to or greater than a circumferential length L32 of the second key support 1832, and more precisely the circumferential length L22 of the second key 186. When the circumferential length L14 of the fourth axial support surface 1844 is greater than the circumferential length L22 of the second key 186, it may increase stability of behavior of the Oldham ring 180 and the orbiting scroll 140, as in the first axial support surface 1841 to third axial support surface 1843.

The Oldham ring according to embodiments may provide the following operation effects.

That is, the ring 181 of the Oldham ring 180 according to this embodiment may be located between the main frame 130 and the orbiting scroll 140. The first key 185 and the second key 186 of the Oldham ring 180 may axially extend from one surface of the ring 181, for example, the second surface 181*b* that faces the orbiting scroll 140. The first key 185 may be slidingly inserted into the first key groove 141*a* provided in the orbiting scroll 140, and the second key 186 may be slidingly inserted into the second key groove 154*b* provided in the non-orbiting scroll 150.

The orbiting scroll 140 may almost be in contact with the second surface 181*b* of the ring 181, whereas the non-orbiting scroll 150 may be located farther away from the second surface 181*b* with the orbiting scroll 140 interposed therebetween. Thus, an axial height of the second key 186 may be considerably greater than an axial height of the first key 185. This may cause an increase in length of a moment arm with respect to the second key 186. As a result, a Z-direction, which is an axial direction of the Oldham ring 180, deformation, namely, warping of the ring 181 may be significantly increased.

When warping of the Oldham ring 180 increases, not only behavior of the Oldham ring 180 itself but also behavior of the orbiting scroll 140 become unstable. Then, the orbiting scroll 140 is spaced apart from the non-orbiting scroll 150, and leakage between the compression chambers occurs, which may lead to a decrease in compression efficiency and an increase in friction loss at the first key 185 and the second key 186.

Stability may be increased by providing the reinforcing portion 180*a* at the ring 181, as in the embodiment, thereby minimizing deformation of the Oldham ring 180. The reinforcing portion 180*a* may be formed over the entire ring 181. However, when the reinforcing portion 180*a* is provided over the entire ring 181, a size of the Oldham ring 180 increases accordingly. Then, the weight of the Oldham ring 180 also increases, which is not desirable in terms of motor efficiency and compressor performance. Thus, in terms of motor efficiency and compressor performance, the reinforcing portion 180*a* may only be provided at portions of the Oldham ring 180 at which stress is concentrated.

Normally, the portions at which stress is concentrated in the Oldham ring 180 are portions where the first key 185 and the second key 186 are provided. In this embodiment, these portions are the first key support 1831 and the second key support 1832, respectively. Accordingly, the reinforcing portion 180*a* may be provided around the first key support 1831 and the second key support 1832, respectively. However, considering behavior characteristics of the Oldham ring 180 and shapes of the first key 185, the second key 186, and the main frame 130, the reinforcing portion 181*a* may not be provided at the second key support 1832. Therefore, the reinforcing portion 180*a* is provided in the vicinity of the first key support 1831.

That is, the Oldham ring 180 is seated or placed on the Oldham ring accommodating portion 135 provided on the main frame 130 so as to perform an orbiting motion together with the orbiting scroll 140. The plurality of scroll fixing portions 136 is provided at an outside of the Oldham ring accommodating portion 135, and the second key 186 of the Oldham ring 180 performs an orbiting motion at a position that interferes with a circumferential direction of the scroll fixing portion 136. Accordingly, when the reinforcing portion 180*a* is formed in the vicinity of the second key support 1832 provided with the second key 186, the scroll fixing portion 136 of the main frame 130 may interfere with the reinforcing portion 180*a* while the reinforcing portion 180*a* performs an orbiting motion.

Nevertheless, for providing the reinforcing portion 180*a* at the second key support 1832, an outer diameter of the main frame 130 should be increased to avoid interference between the reinforcing portion 180*a* and the scroll fixing portion 136. Therefore, the reinforcing portion 180*a* may be provided in the vicinity of the first key support 1831, as described above.

As the radial width D1 around the first key 185, namely, the first key support 1831 is greater than the radial width D2 of the second key support 1832, the Oldham ring 180 according to this embodiment may increase a force against the twisting (or torsional) moment. Accordingly, an amount of Z direction deformation of the Oldham ring 180 may be reduced, thereby stabilizing behavior of the Oldham ring 180 and the orbiting scroll 140.

In addition, as the behavior of the Oldham ring 180 and the orbiting scroll 140 are stabilized, leakage between the compression chambers may be suppressed, thereby increasing compression efficiency. Further, compressor efficiency may be improved by reducing friction loss at the first key 185 and the second key 186.

When the reinforcing portion 180*a* is provided at the Oldham ring 180, the weight of the Oldham ring 180 may be increased. This is disadvantageous in terms of motor efficiency and compressor performance. Accordingly, as in the embodiment, the Oldham ring 180 may be provided with a weigh-reduced portion within a range that can secure proper rigidity of the Oldham ring 180.

The Oldham ring 180 according to embodiments may reduce the entire weight of the Oldham ring 180 by providing the weigh-reduced portion while forming the reinforcing portion 180*a*. This may allow motor efficiency and compressor performance to be enhanced.

In addition, in the embodiment, weight-reduced portions may be provided at relatively heavier portions of the Oldham ring 180 along the circumferential direction. For example, the first weight-reduced portion 1821, second weight-reduced portion 1822, and third weight-reduced portion 1823 may be provided in the vicinity of the first key support 1831, and the fourth weight-reduced portion 1824 may be provided at the second key support 1832. Accordingly, the Oldham ring 180 according to this embodiment may be formed such that weight of the Oldham ring 180 is even (or constant) to a certain degree along the circumferential direction while partially forming the reinforcing portion 180*a*.

The effects of the Oldham ring according to embodiments disclosed herein may be seen in the following Table 1.

TABLE 1

| | Patent Document 1 | Patent Document 2 | Embodiments |
|---|---|---|---|
| Amount of R-direction deformation (μm) | 51.7 | 26.8 | 22.4 |
| Amount of T-direction deformation (μm) | 39.1 | 61.4 | 48.4 |
| Amount of Z-direction deformation (μm) | 3.4 | 67.8 | 54.6 |
| Maximum stress (Mpa) | 23.8 | 31.6 | 24.7 |
| Safety factor | 6.51 | 4.91 | 6.28 |
| Weight (g) | 46.8 | 65.8 | 55.7 |

Here, a R-direction is a radial direction, a T-direction is a tangential direction, and a Z-direction is an axial direction with respect to the Oldham ring on the plane.

As shown in the Table 1 above, it can be seen that the amount of R-direction deformation is greatly reduced compared to Patent Document 1. This is because the reinforcing portion is provided at the ring of the Oldham ring according to embodiments. More particularly, in embodiments, the amount of R-direction deformation is reduced even compared to Patent Document 2.

The amount of T-direction deformation is slightly increased compared to Patent Document 1. Compared to Patent Document 2, a diameter of the ring according to embodiments is increased, which is due to a 'one-way' anti-rotation member. A 'two-way' anti-rotation member is employed in Patent Document 2, whereas the one-way anti-rotation member is used in embodiments. However, it can be seen that the amount of T-direction deformation of embodiments is significantly lower than the amount of T-direction deformation of Patent Document 2. This can also be achieved by providing the reinforcing portion at the ring of the Oldham ring.

In the case of the amount of Z-direction deformation, it is significantly increased compared to Patent Document 1. Due to characteristics of the one-way anti-rotation member, a load is applied to both keys in the same direction, and an axial length of the keys is increased, compared to the two-way anti-rotation member employed in Patent Document 1. It can be seen that the amount of Z-direction deformation is also increased in Patent Document 2. However, the amount of Z-direction deformation of embodiments is lower than that of Patent Document 2. This can be achieved by providing the reinforcing at the ring portion of the Oldham ring.

In addition, it can be seen that the maximum stress of embodiments is similar to the maximum stress of Patent Document 1, and is significantly lower than that of Patent Document 2. This is because the reinforcing portion provided at the ring of the Oldham ring suppresses the maximum stress from being increased.

As for the safety factor (or factor of safety), it can be seen that the safety factor in embodiments is substantially similar to the safety factor of Patent Document 1, and is greatly improved compared to Patent Document 2. This is because the amount of deformation is minimized even when employing the one-way anti-rotation member by providing the reinforcing portion at the ring of the Oldham ring.

In the case of weight, the weight of the Oldham ring of embodiments is significantly increased compared to Patent Document 1, but is greatly reduced compared to Patent Document 2. This can be seen from the fact that an increase in the weight of the Oldham ring is suppressed as much as possible by providing the weight-reduced portion in addition to the reinforcing portion at the Oldham ring according to embodiments.

Hereinafter, description will be given of an Oldham ring according to another embodiment.

That is, in the previous embodiment, the circumferential length L31 of the first key support 1831 (or first direction of the first key support) is substantially equal to the circumferential length L43 of the third weight-reduced portion 1823 (or first direction of the first weight-reduced portion). In this embodiment, however, the circumferential length L31 of the first key support 1831 (or first direction of the first key support) is greater than the circumferential length L43 of the third weight-reduced portion 1823 (or first direction of the first weight-reduced portion).

Figure 19:
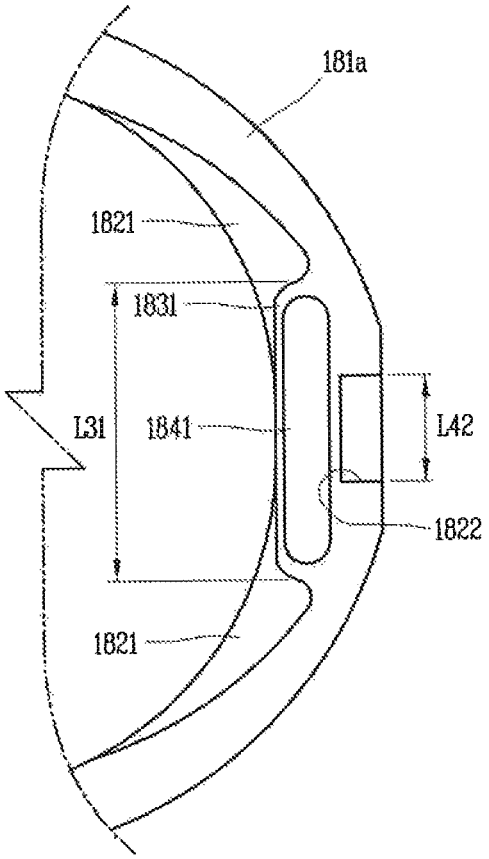
FIG. 19 is a bottom view illustrating another example of an Oldham ring according to an embodiment.

FIG. 19 is a bottom view illustrating another example of an Oldham ring according to an embodiment. The Oldham ring 180 according to this embodiment has the same basic configurations and same effects as the previous embodiment. However, referring to FIG. 19, in the Oldham ring 180 according to this embodiment, the circumferential length L31 of the first key support 1831 is greater than a circumferential length L42 of the second weight-reduced portion 1822.

The first key support 1831 may be constant along an inner curvature of the ring 181. However, an area of the first key support 1831 increases, which causes an increase in weight of the Oldham ring 180.

Thus, an inner surface of the first key support 1831 according to this embodiment may be formed as a straight surface. In this case, a tail portion (no reference numeral) extending in the circumferential direction may be provided at each end of the first weight-reduced portions 1821. Accordingly, the Oldham ring 180 according to this embodiment may be more advantageous in terms of stability as the first key support 1831 is greater than that of the embodiment illustrated in FIG. 11. However, as the first key support 1831 increases in length, the weight of the Oldham ring 180 may be increased compared to the embodiment of FIG. 11. Accordingly, the first weight-reduced portion 1821 may be as large as the tail portion to further reduce the weight of the Oldham ring 180.

Hereinafter, description will be given of an Oldham ring according to yet another embodiment.

That is, in the previous embodiments, the first weight-reduced portions are wider toward the first key. In this embodiment, however, the first weight-reduced portions are symmetrically formed between the first key and the second key.

Figure 20:
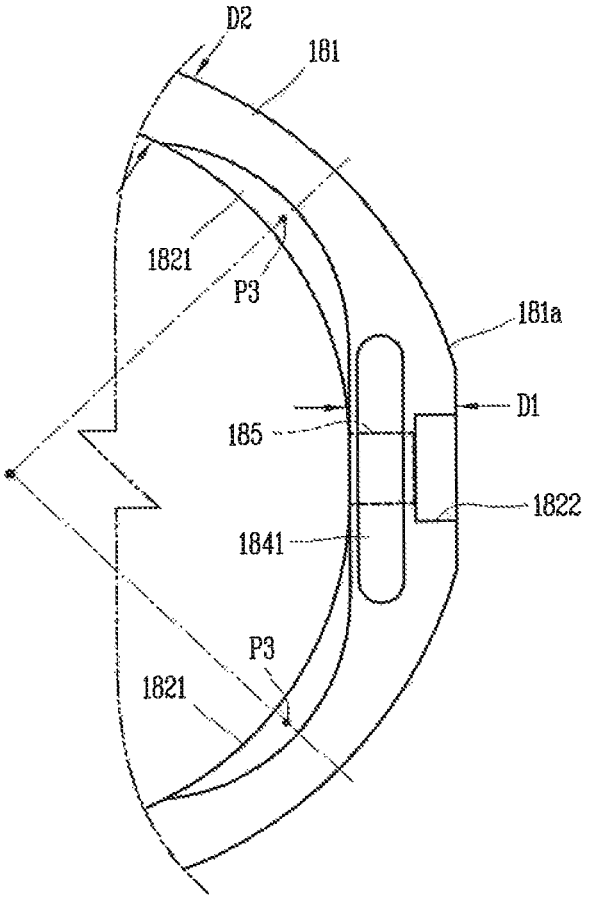
FIG. 20 is a bottom view illustrating another example of a first weight-reduced portion in the Oldham ring according an embodiment.

FIG. 20 is a bottom view illustrating another example of a first weight-reduced portion in the Oldham ring according an embodiment. The Oldham ring 180 according to this embodiment has the same basic configurations and same effects as the previous embodiments. However, referring to FIG. 20, in the Oldham ring 180 according to this embodiment, the first weight-reduced portion 1821 may be symmetrically formed with respect to a center of any one point between the first point P1 and the second point P2. The one point may be a third point P3.

As described above, when the first weight-reduced portion 1821 according to this embodiment is symmetrically provided between the first point P1 and the second point P2 (or between the first key and the second key), both ends of the first eight-reduced portion 1821 facing the first key 185 or the second key 186 have a smaller area than a middle portion of the first weight-reduced portion 1821. Accordingly, a cross-sectional area of the ring 181 adjacent to the first key 185 and the second key 186, and more precisely, a cross-sectional area excluding the first weight-reduced portion 1821 is increased, which may allow rigidity of the first key 185 and the second key 186 to be enhanced. As a result, stress generated in the vicinity of the first key 185 and the second key 186 may be reduced, thereby increasing reliability.

Hereinafter, description will be given of an Oldham ring according to yet another embodiment. That is, in the previous embodiments, the first to third weight-reduced portions are configured as one recess (or groove), respectively. However, the first to third weight-reduced portions may be implemented as a plurality of recesses. Hereinafter, the first weight-reduced portion will be described as a representative example, but this may also be equally applied to the second or third weight-reduced portion.

Figure 21:
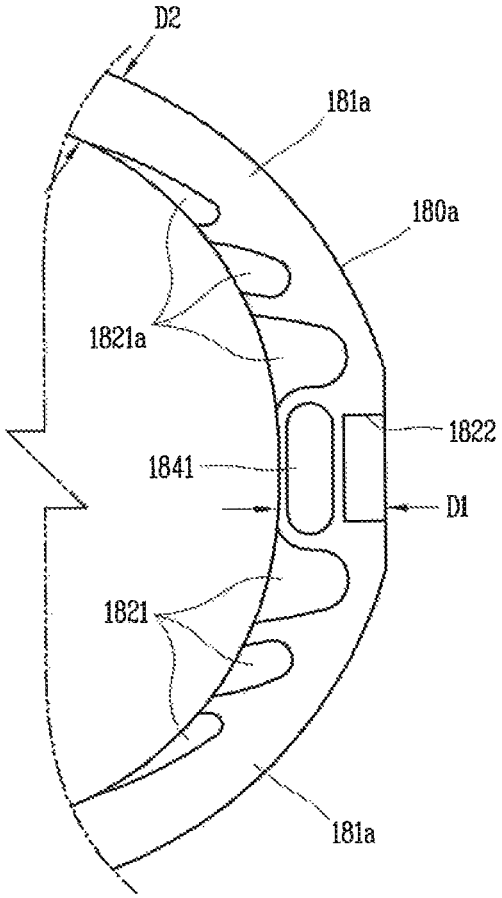
FIGS. 21 and 22 are planar views illustrating another example of a first weight-reduced portion according an embodiment.
Figure 22:
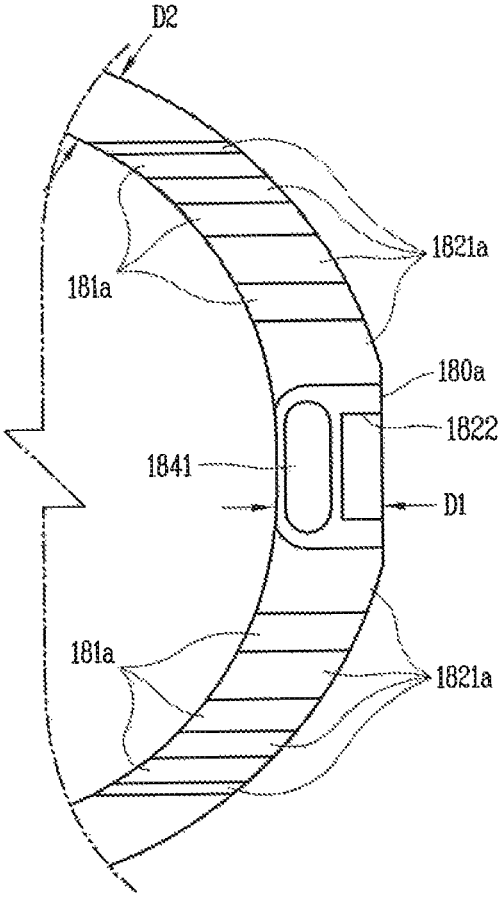

FIGS. 21 and 22 are planar views illustrating another example of a first weight-reduced portion according an embodiment. The first weight-reduced portion 1821 according to embodiments illustrated in FIGS. 21 and 22 may be configured as a plurality of recesses 1821*a* formed at a predetermined interval along the circumferential direction. The plurality of recesses 1821*a* may have a same size, but as shown in FIGS. 21 and 22, an area of each of the recesses 1821 may be increased toward the first key (or first virtual line) 185.

In addition, the plurality of recesses 1821*a* may be formed on the inner circumferential surface (or outer circumferential surface in the case of the second weight-reduced portion) of the ring 181, as shown in FIG. 21. Alternatively, the plurality of recesses 1821*a* may penetrate between the inner circumferential surface and the outer circumferential surface of the ring 181, as illustrated in FIG. 22.

As such, when the plurality of recesses 1821*a* defining the first weight-reduced portion 1821 is spaced apart from each other by the predetermined interval along the circumferential direction, the first surface 101*a* defining a bottom (or lower) surface of the ring 181 is left between the plurality of recesses 1821*a*. The first surface 181*a* remaining between the recesses serves as a kind of reinforcing portion, which may suppress or compensate a decrease in rigidity of the Oldham ring 180 due to the first weight-reduced portion 1821*a* provided at the ring 181.

In the previous embodiments, an example in which the weight-reduced portion is formed in a groove shape recessed in the first surface or the second surface of the ring, but the weight-reduced portion is not necessarily limited to the recess. For example, the weight-reduced portion may be formed as a hole within a range that can secure rigidity of the Oldham ring.

Further, in the previous embodiments, an example in which the axial support surface extends from the first key or is provided at a position that radially overlaps in the vicinity of the first and second keys, but the position of the axial support surface may not be limited thereto. For example, the axial support surface may be formed between the first key and the second key. However, even in this case, all of the axial support surfaces may have the same height, which is more suitable for stabilizing behavior of the Oldham ring and the orbiting scroll.

In a scroll compressor according to embodiments disclosed herein, a first key and a second key may axially extend from one surface of a ring portion or ring, and the first and second keys may be located on each of virtual lines that passes through a center of the ring portion. Accordingly, an alignment degree of a frame, an orbiting scroll, and a non-orbiting scroll disposed with respect to an anti-rotation member may be improved, and processability (or workability) of the orbiting scroll and the non-orbiting scroll coupled to the anti-rotation member may also be enhanced. As a result, reliability of the scroll compressor may be improved and manufacturing costs of the scroll compressor may be reduced.

Further, in the scroll compressor according to embodiments disclosed herein, a radial width of the ring portion may vary, and the radial width of the ring portion corresponding to a portion that is greatly affected by stress and a twisting moment. By doing so, the ring portion may be prevented from being deformed by the stress and twisting moment even when a 'one-way' anti-rotation member is employed, thereby increasing durability of the anti-rotation member. Further, motor efficiency and compressor performance may be improved by reducing friction loss between the key and a key groove.

Furthermore, in the scroll compressor according to embodiments disclosed herein, even if a weight of the ring portion is increased as the radial width of the ring portion increases, it is possible to suppress a substantial increase in weight of the ring portion by providing a weight-reduced portion at the ring portion. As a result, a decrease in motor efficiency and compressor performance may be prevented.

In addition, in the scroll compressor according to embodiments disclosed herein, as an axial support surface is respectively provided on both surfaces in an axial direction of the ring portion in a protruding manner, a frictional area between the ring portion and a member facing the ring portion may be reduced while stabilizing behavior of the anti-rotation member and the orbiting scroll. This may allow leakage between compression chambers to be prevented, leading to an increase in compression efficiency.

Embodiments disclosed herein provide a scroll compressor that can address shortcomings of a 'two-way' anti-rotation member and disadvantages of a 'one-way' anti-rotation member. Embodiments disclosed herein further provide a scroll compressor that can increase a degree of alignment of a frame, orbiting scroll, and non-orbiting scroll arranged with respected to an anti-rotation member configured as a one-way rotation member, and improve processability of components coupled to the anti-rotation member. Embodiments disclosed herein furthermore provide a scroll compressor that can suppress an increase in weight while maintaining rigidity capable of suppressing deformation caused by stress and a twisting moment even when a one-way rotation member is employed.

Embodiments disclosed herein may provide an anti-rotation member having a ring portion or ring, a first key, and a second key. The ring portion may include a plurality of first ring portions or rings at which the first key is provided, and a plurality of second ring portions or rings at which the second key is provided, each extending from both ends of the first ring portion. A radial width of the first ring portion may be greater than a radial width of the second ring portion.

Embodiments disclosed herein may also provide an anti-rotation member having a ring portion or ring, a first key, and a second key. A plurality of the first and second keys may be provided. Inner circumferential surfaces of the ring portion defining an inner surface of the first key may be formed as a straight line so as to be parallel to each other, and outer circumferential surfaces of the ring portion defining an outer surface of the first key may be formed as a curve surface. A recess recessed from a surface of the ring portion in an axial direction may be provided in a vicinity of the first key or the second key.

Embodiments disclosed herein also provide a scroll processor that may include a frame; an orbiting scroll supported on one surface of the frame and performing an orbiting motion; a non-orbiting scroll supported on one surface of the frame with the orbiting scroll interposed therebetween, and coupled to the orbiting scroll so as to form a compression chamber; and an anti-rotation member disposed between the frame and the orbiting scroll and slidingly coupled to the orbiting scroll and the non-orbiting scroll, so as to restrain rotation of the orbiting scroll. The anti-rotation member may include a ring portion or ring having an annular shape, a first key that extends from the ring portion and slidingly coupled to the orbiting scroll, and a second key that extends from the ring portion and slidingly coupled to the non-orbiting scroll. The first key and the second key may extend in a same axial direction, and each of the first and second keys may be provided at a position where each of virtual lines, extending from respective centers of the first key and the second key to respective sliding directions, passes through a center of the ring portion.

The ring portion may include a plurality of first ring portions or rings at which the first key may be provided, and a plurality of second ring portions or rings at which the second key may be provided, each extending from both ends of the first ring portion to define an annular-shaped ring portion. A radial width of the first ring portion may be greater than a radial width of the second ring portion.

In addition, the first ring portion and the second ring portion may be provided with a weight-reduced portion, respectively. The weight-reduced portion of the first ring portion may be greater than the weight-reduced portion of the second ring portion.

Embodiments disclosed herein further provide a scroll processor that may include a frame; an orbiting scroll provided with a first key groove and supported on one surface of the frame to perform an orbiting motion; a non-orbiting scroll provided with a second key groove, supported on one surface of the frame with the orbiting scroll interposed therebetween, and coupled to the orbiting scroll so as to form a compression chamber; and an anti-rotation member disposed between the frame and the orbiting scroll and restraining rotation of the orbiting scroll. The anti-rotation member may include a ring portion or ring having an annular shape, a first key that axially extends from a first surface of the ring portion and slidingly coupled to the first key groove of the orbiting scroll in a first direction, and a second key that axially extends from the first surface of the ring portion and slidingly coupled to the second key groove of the non-orbiting scroll in a second direction orthogonal to the first direction. The first key and the second key may be provided along a circumferential direction at equal intervals. The ring portion may be formed such that a length in the first direction in which the first key is provided is greater than a length in the second direction in which the second key is provided.

A radial width of the ring portion may increase toward the first key with respect to the second key. A first weight-reduced portion may be provided at the ring portion, and the first weight-reduced portion may be provided between the first key and the second key. In addition, the first weight-reduced portion may be formed such that a radial width increases toward the first key.

A first key support portion or support may be provided between ends of one side of the first weight-reduced portion facing the first key. The first key support portion may be provided with a first axial support surface that protrudes by a predetermined height. The first axial support surface may overlap at least a portion of the first key in an axial direction.

A second weight-reduced portion may be provided at one side of the first axial support surface in a radial direction. The second weight-reduced portion may overlap at least a portion of the first key in the axial direction. A circumferential length of the second weight-reduced portion may be equal to or less than a circumferential length of the first axial support surface.

A third weight-reduced portion may be provided on a second surface of the ring portion. The third weight-reduced portion may be provided on one side of the first key in the radial direction. An area of the third weight-reduced portion may increase toward the first key. The third weight-reduced portion may be provided at a position at which at least a portion of the weight-reduced portion overlaps the first weight-reduced portion or the second weight-reduced portion in the circumferential direction.

A third axial support surface may be provided on a second surface of the ring portion. The third axial support surface may extend from both surfaces of the first key in a circumferential direction.

A second key support portion defining the second key may extend from an outer circumferential surface of the ring portion in a radial direction. The second key support portion may be provided with a fourth weight-reduced portion recessed in an axial direction. A second axial support surface may be provided on one side of the fourth weight-reduced portion in the radial direction. The fourth weight-reduced portion may be stepped along the axial direction. A fourth axial support surface that protrudes from the first surface of the ring portion by a predetermined height may be provided on one side of the fourth weight-reduced portion in the radial direction.

The ring portion may be provided with a weight-reduced portion. The weight-reduced portion may be provided on an outer circumferential surface or an inner circumferential surface of the ring portion in a stepped manner.

The ring portion may be provided with a weight-reduced portion. The weight-reduced portion may be recessed between an outer circumferential surface and an inner circumferential surface of the ring portion.

The orbiting scroll may be provided with an orbiting end plate having a disk shape, the first key groove may be provided on one surface of the orbiting end plate, and an orbiting wrap may be provided on another surface of the orbiting end plate. The first key groove may be provided at a position at which at least a portion thereof overlaps the orbiting wrap in axial projection. The anti-rotation member may be made of an aluminum material.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer, or section from another region, layer, or section. Thus, a first element, component, region, layer, or section could be termed a second element, component, region, layer, or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A scroll compressor, comprising:

a frame;

an orbiting scroll provided with at least one first key groove and supported on one surface of the frame to perform an orbiting motion;

a non-orbiting scroll provided with at least one second key groove, supported on one surface of the frame with the orbiting scroll interposed therebetween, and coupled to the orbiting scroll so as to form a compression chamber; and an anti-rotation ring disposed between the frame and the orbiting scroll and restraining rotation of the orbiting scroll, wherein the anti-rotation ring comprises:

a ring having an annular shape;

at least one first key that axially extends from a first surface of the ring and slidingly coupled to the at least one first key groove of the orbiting scroll in a first direction; and at least one second key that axially extends from the first surface of the ring and slidingly coupled to the at least one second key groove of the non-orbiting scroll in a second direction orthogonal to the first direction, wherein the at least one first key and the at least one second key are provided along a circumferential direction of the ring at equal intervals, wherein a radial width of the ring increases toward the at least one first key with respect to the at least one second key, wherein a first weight-reduced portion is provided at the ring between the at least one first key and the at least one second key, wherein the at least one first key is provided adjacent an end of one side of the first weight-reduced portion, wherein a first key support is provided with a first axial support surface that protrudes by a predetermined height, wherein the first axial support surface overlaps at least a portion of the at least one first key in an axial direction, wherein a second weight-reduced portion is provided at one side of the first axial support surface in a radial direction, and wherein the second weight-reduced portion overlaps at least a portion of the at least one first key in the axial direction.

2. The scroll compressor of claim 1, wherein the ring is formed such that the at least one second key extends from the first surface by a length that is greater than a length that the at least one first key extends from the first surface.

3. The scroll compressor of claim 1, wherein the first weight-reduced portion is formed such that a radial width increases from the at least one second key toward the at least one first key.

4. The scroll compressor of claim 1, wherein a circumferential length of the second weight-reduced portion is equal to or less than a circumferential length of the first axial support surface.

5. The scroll compressor of claim 1, wherein a third weight-reduced portion is provided on a second surface of the ring, and wherein the third weight-reduced portion is provided at one side of the at least one first key in the radial direction.

6. The scroll compressor of claim 5, wherein an area of the third weight-reduced portion increases from the at least one second key toward the at least one first key.

7. The scroll compressor of claim 5, wherein the third weight-reduced portion is provided at a position at which at least a portion of the third weight-reduced portion overlaps the first weight-reduced portion or the second weight-reduced portion in the circumferential direction.

8. The scroll compressor of claim 1, wherein an axial support surface is provided on a second surface of the ring, and wherein the axial support surface extends from both surfaces of the at least one first key in the circumferential direction.

9. The scroll compressor of claim 1, wherein a key support defining the at least one second key extends from an outer circumferential surface of the ring in the radial direction, wherein the key support is provided with a weight-reduced portion recessed in an axial direction, and wherein an axial support surface is provided at one side of the weight-reduced portion in the radial direction.

10. The scroll compressor of claim 9, wherein the weight-reduced portion is stepped along the axial direction, and wherein an axial support surface that protrudes from the first surface of the ring by a predetermined height is provided at one side of the weight-reduced portion in the radial direction.

11. A scroll compressor, comprising:

a frame;

an orbiting scroll provided with at least one first key groove and supported on one surface of the frame to perform an orbiting motion;

a non-orbiting scroll provided with at least one second key groove, supported on one surface of the frame with the orbiting scroll interposed therebetween, and coupled to the orbiting scroll so as to form a compression chamber; and an anti-rotation ring disposed between the frame and the orbiting scroll and restraining rotation of the orbiting scroll, wherein the anti-rotation ring comprises:

a ring having an annular shape;

at least one first key that axially extends from a first surface of the ring and slidingly coupled to the at least one first key groove of the orbiting scroll in a first direction; and at least one second key that axially extends from the first surface of the ring and slidingly coupled to the at least one second key groove of the non-orbiting scroll in a second direction orthogonal to the first direction, wherein the orbiting scroll is provided with an orbiting end plate having a disk shape, the at least one first key groove is provided on a first surface of the orbiting end plate, and an orbiting wrap is provided on a second surface of the orbiting end plate, wherein the at least one first key groove is provided at a position at which at least a portion thereof overlaps the orbiting wrap in axial projection, wherein a key support defining the at least one second key extends from an outer circumferential surface of the ring in a radial direction, wherein the key support is provided with a weight-reduced portion recessed in an axial direction, and wherein an axial support surface is provided at one side of the weight-reduced portion in the radial direction.

12. The scroll compressor of claim 11, wherein the ring is further provided with a weight-reduced portion at an outer circumferential surface or an inner circumferential surface of the ring in a stepped manner.

13. The scroll compressor of claim 11, wherein the ring is further provided with a weight-reduced portion recessed between an outer circumferential surface and an inner circumferential surface of the ring.

14. The scroll compressor of claim 11, wherein the anti-rotation ring is made of an aluminum material.

15. The scroll compressor of claim 11, wherein the weight-reduced portion is stepped along the axial direction, and wherein an axial support surface that protrudes from the first surface of the ring by a predetermined height is provided at one side of the weight-reduced portion in the radial direction.

16. A scroll compressor, comprising:

a frame;

an orbiting scroll supported on one surface of the frame and performing an orbiting motion;

a non-orbiting scroll supported on the one surface of the frame with the orbiting scroll interposed therebetween, and coupled to the orbiting scroll so as to form a compression chamber; and an anti-rotation ring disposed between the frame and the orbiting scroll and slidingly coupled to the orbiting scroll and the non-orbiting scroll, so as to restrain rotation of the orbiting scroll, wherein the anti-rotation ring comprises:

a ring having an annular shape;

at least one first key that extends from the ring and slidingly coupled to the orbiting scroll; and at least one second key that extends from the ring and slidingly coupled to the non-orbiting scroll, wherein the at least one first key and the at least one second key extend in a same axial direction, and each of the at least one first key and the at least one second key is provided at a position at which each of virtual lines, extending from respective centers of the at least one first key and the at least one second key to respective sliding directions, passes through a center of the ring, wherein a key support defining the at least one second key extends from an outer circumferential surface of the ring in a radial direction, wherein the key support is provided with a weight-reduced portion recessed in an axial direction, and wherein an axial support surface is provided at one side of the weight-reduced portion in the radial direction.

17. The scroll compressor of claim 16, wherein the ring comprises:

a plurality of first ring portions at which the at least one first key is provided; and a plurality of second ring portions at which the at least one second key is provided, each extending from both ends of the plurality of first ring portions to define an annular-shaped ring, and wherein a radial width of the plurality of first ring portions is greater than a radial width of the plurality of second ring portions.

18. The scroll compressor of claim 17, wherein the plurality of first ring portions and the plurality of second ring portions are provided with a weight-reduced portion, respectively, and wherein a radial width of the weight-reduced portion of the plurality of first ring portions is greater than the radial width of the weight-reduced portion of the plurality of second ring portions.

19. The scroll compressor of claim 16, wherein the ring is further provided with a weight-reduced portion at an outer circumferential surface or an inner circumferential surface of the ring in a stepped manner.

20. The scroll compressor of claim 16, wherein the ring is further provided with a weight-reduced portion recessed between an outer circumferential surface and an inner circumferential surface of the ring.

21. The scroll compressor of claim 16, wherein the weight-reduced portion is stepped along the axial direction, and wherein an axial support surface that protrudes from the first surface of the ring by a predetermined height is provided at one side of the weight-reduced portion in the radial direction.

* * * * *